US008398421B2

(12) United States Patent
Haberek et al.

(10) Patent No.: US 8,398,421 B2
(45) Date of Patent: Mar. 19, 2013

(54) CONNECTOR HAVING A DIELECTRIC SEAL AND METHOD OF USE THEREOF

(75) Inventors: Andrew Haberek, Baldwinsville, NY (US); Christopher P. Natoli, Fulton, NY (US); Eric Purdy, Constantia, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 100 days.

(21) Appl. No.: 13/018,727

(22) Filed: Feb. 1, 2011

(65) Prior Publication Data

US 2012/0196476 A1 Aug. 2, 2012

(51) Int. Cl.
*H01R 13/52* (2006.01)

(52) U.S. Cl. ..... 439/277; 439/578

(58) Field of Classification Search ..... 439/271, 439/277, 578

See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Notice of Allowance (Date Mailed: Dec. 29, 2011) for U.S. Appl. No. 12/906,243, filed Oct. 18, 2010.

(Continued)

*Primary Examiner* — Tho D Ta
*Assistant Examiner* — Larisa Tsukerman
(74) *Attorney, Agent, or Firm* — Schmeiser, Olsen & Watts, LLP

(57) ABSTRACT

A coaxial cable connector having a connector body attached to a post, the post having a first end, a second end, and a flange proximate the first end, wherein the post is configured to receive a center conductor surrounded by a dielectric of a coaxial cable, a port coupling element attached to the post, and a seal member disposed proximate the dielectric to create a seal around the dielectric to prevent entry of environmental elements is provided. Additionally, a connector having a post with an internally tapered surface proximate a first end, the internally tapered surface tapering radially inward toward the first end to compress the dielectric to form a seal around the dielectric is provided. Furthermore, an associated method is also provided.

28 Claims, 18 Drawing Sheets

U.S. PATENT DOCUMENTS

| | | | |
|---|---|---|---|
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |

4,588,246 A 5/1986 Schildkraut et al.
4,593,964 A 6/1986 Forney, Jr. et al.
4,596,434 A 6/1986 Saba et al.
4,596,435 A 6/1986 Bickford
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen 5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 * 4/2001 Langham et al. ..... 439/583
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 * 3/2004 Youtsey ..... 439/322
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 * 8/2005 Holland ..... 439/579
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 * 8/2006 Purdy ..... 439/578
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland et al.
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 * 7/2010 Montena ..... 439/277
7,753,727 B1 7/2010 Islam et al.
7,794,275 B2 9/2010 Rodrigues

| | | | | |
|---|---|---|---|---|
| 7,806,714 | B2 | 10/2010 | Williams et al. | |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 * | 2/2011 | Holliday | 439/321 |
| 7,892,004 | B2 | 2/2011 | Hertzler et al. | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 8,029,315 | B2 | 10/2011 | Purdy et al. | |
| 8,062,044 | B2 | 11/2011 | Montena et al. | |
| 8,075,338 | B1 | 12/2011 | Montena | |
| 8,079,860 | B1 | 12/2011 | Zraik | |
| 8,152,551 | B2 | 4/2012 | Zraik | |
| 8,167,635 | B1 * | 5/2012 | Mathews | 439/277 |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 * | 5/2004 | Chee | 439/578 |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy et al. | |
| 2010/0279548 | A1 * | 11/2010 | Montena et al. | 439/620.04 |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |
| 2012/0094532 | A1 | 4/2012 | Montena | |
| 2012/0122329 | A1 | 5/2012 | Montena et al. | |
| 2012/0145454 | A1 | 6/2012 | Montena | |
| 2012/0202378 | A1 | 8/2012 | Krenceski et al. | |
| 2012/0214342 | A1 | 8/2012 | Mathews | |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B9 | 4/2010 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

OTHER PUBLICATIONS

Notice of Allowance (Date Mailed: Jan. 3, 2012) for U.S. Appl. No. 12/906,576, filed Oct. 18, 2010.

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

U.S. Appl. No. 12/906,243, filed Oct. 18, 2010.

U.S. Appl. No. 12/906,276, filed Oct. 18, 2010.

PCT/US2012/023443 Date of mailing: Jun. 8, 2012 International Search Report and Written Opinion. pp. 12.

Office Action (Mail Date: Jul. 9, 2012) for U.S. Appl. No. 13/461,215, filed May 1, 2012.

* cited by examiner

CONNECTOR HAVING A DIELECTRIC SEAL AND METHOD OF USE THEREOF

FIELD OF TECHNOLOGY

The following relates to connectors used in coaxial cable communication applications, and more specifically to embodiments of a connector having a seal created proximate a dielectric of a coaxial cable.

BACKGROUND

Connectors for coaxial cables are typically connected onto complementary interface ports to electrically integrate coaxial cables to various electronic devices. Connectors are often utilized to connect coaxial cables to various communications modifying equipment such as signal splitters, cable line extenders and cable network modules. In some instances, the coaxial cable is even run directly from a satellite dish located outside to an electronic device located inside, such as a living room television. Because these coaxial cables are present outdoors, they are exposed to weather and other numerous environmental elements, as well as damage caused by a variety of animals penetrating a protective cable jacket to expose the cable. Weathering, animal attacks, and various environmental elements can work to create interference problems when metallic components corrode, deteriorate or become galvanically incompatible, thereby resulting in intermittent contact and poor electromagnetic shielding. Moreover, precipitation and other environmental pollutants may enter the internals of the coaxial cable connector located outside, or travel down the environmentally exposed cable and enter the internals of the coaxial cable connector located inside, prompting a hazardous situation, such as a blazing house fire.

Thus, a need exists for an apparatus and method for sealing an end of a coaxial cable to prevent ingress of environmental pollutants.

SUMMARY

A first general aspect relates to a connector comprising a connector body attached to a post, the post having a first end, a second end, and a flange proximate the first end, wherein the post is configured to receive a center conductor surrounded by a dielectric of a coaxial cable, a port coupling element attached to the post, and a seal member disposed proximate the dielectric to create a seal around the dielectric to prevent entry of environmental elements.

A second general aspect relates to a coaxial cable connector comprising a connector body attached to a post, the post having a first end, a second end, and a flange proximate the first end, wherein the post is configured to receive a center conductor surrounded by a dielectric of a coaxial cable, a port coupling element attached to the post; and a seal member integrated with the post to create a seal between the seal member and the dielectric, wherein the seal member integrated with the post is disposed substantially within an annular notch along an inner surface of the post, proximate the center of the flange of the post.

A third general aspect relates to a connector comprising a connector body attached to a post, the post having a first end, a second end, and a flange proximate the first end, wherein the post is configured to receive a center conductor surrounded by a dielectric of a coaxial cable, a port coupling element attached to the post, and a seal member disposed substantially within an annular notch in the flange of the post to provide a barrier around the dielectric to prevent ingress of environmental pollutants, wherein the seal member is flush with a mating edge of the post.

A fourth general aspect relates to a connector comprising a connector body attached to a post, the post having a first end, a second end, and a flange proximate the first end, wherein the post is configured to receive a center conductor surrounded by a dielectric of a coaxial cable, a port coupling element attached to the post, a first seal member disposed within an annular notch in the flange of the post, and a second seal member disposed within the annular notch in the flange of the post, wherein the first seal member and the second seal member disposed within the annular notch of the post provide a barrier around the dielectric to prevent ingress of environmental pollutants.

A fifth general aspect relates to a connector comprising a connector body attached to a post, the post having a first end, a second end, and a flange proximate the first end, wherein the post is configured to receive a center conductor surrounded by a dielectric of a coaxial cable, a port coupling element attached to the post, the port coupling element having an annular notch located along an inner surface of the port coupling element, and a seal member disposed within a generally axial opening of the port coupling element to prevent ingress of environmental pollutants, wherein an outer edge of the seal member is disposed within the annular notch.

A sixth general aspect relates to a connector comprising a connector body attached to a post, the post having a first end, a second end, and a flange proximate the first end, wherein the post is configured to receive a center conductor surrounded by a dielectric of a coaxial cable, and a port coupling element attached to the post, wherein the post has an internally tapered surface proximate the first end, the internally tapered surface tapering radially inward toward the first end to compress the dielectric to form a seal around the dielectric.

A seventh general aspect relates to a connector comprising a connector body attached to a post, the post having a first end, a second end, and a flange proximate the first end, wherein the post is configured to receive a center conductor surrounded by a dielectric of a coaxial cable, a port coupling element attached to the post, and a means for providing a seal around the dielectric, wherein the means include a seal member disposed proximate the dielectric.

An eighth general aspect relates to a method of creating a seal around a dielectric of a coaxial cable, comprising providing a connector including: a connector body attached to a post, the post having a first end, a second end, and a flange proximate the first end, wherein the post is configured to receive a center conductor surrounded by a dielectric of a coaxial cable, and a port coupling element attached to the post; disposing a seal member of proximate the first end of the post to create a seal around the dielectric; and advancing the connector onto an interface port.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
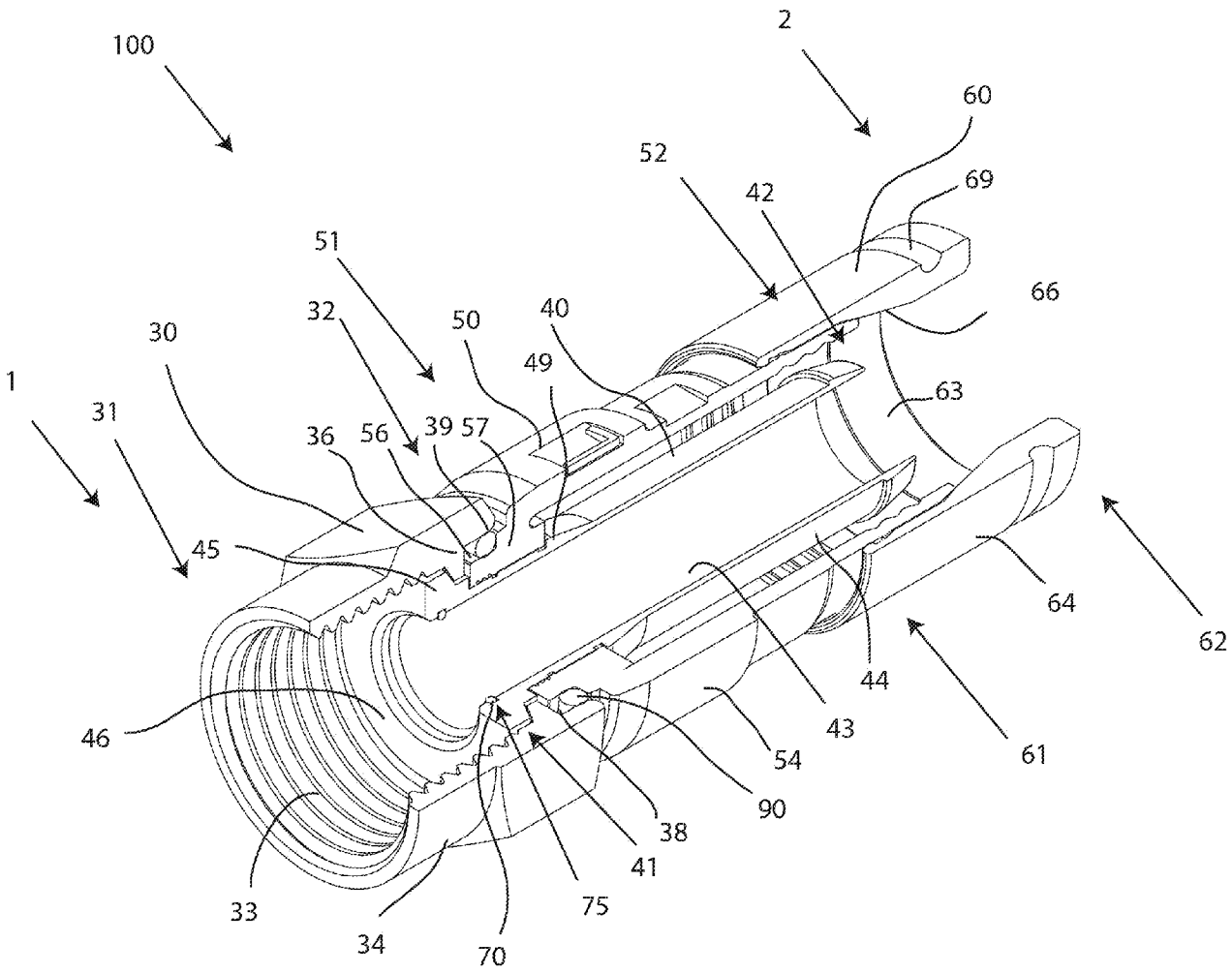
FIG. 1 depicts a perspective cut away view of a first embodiment of a coaxial cable connector having a seal member.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar connector. Furthermore, the connector 100 includes a post 40 configured for receiving a prepared portion of a coaxial cable 10.

Figure 2:
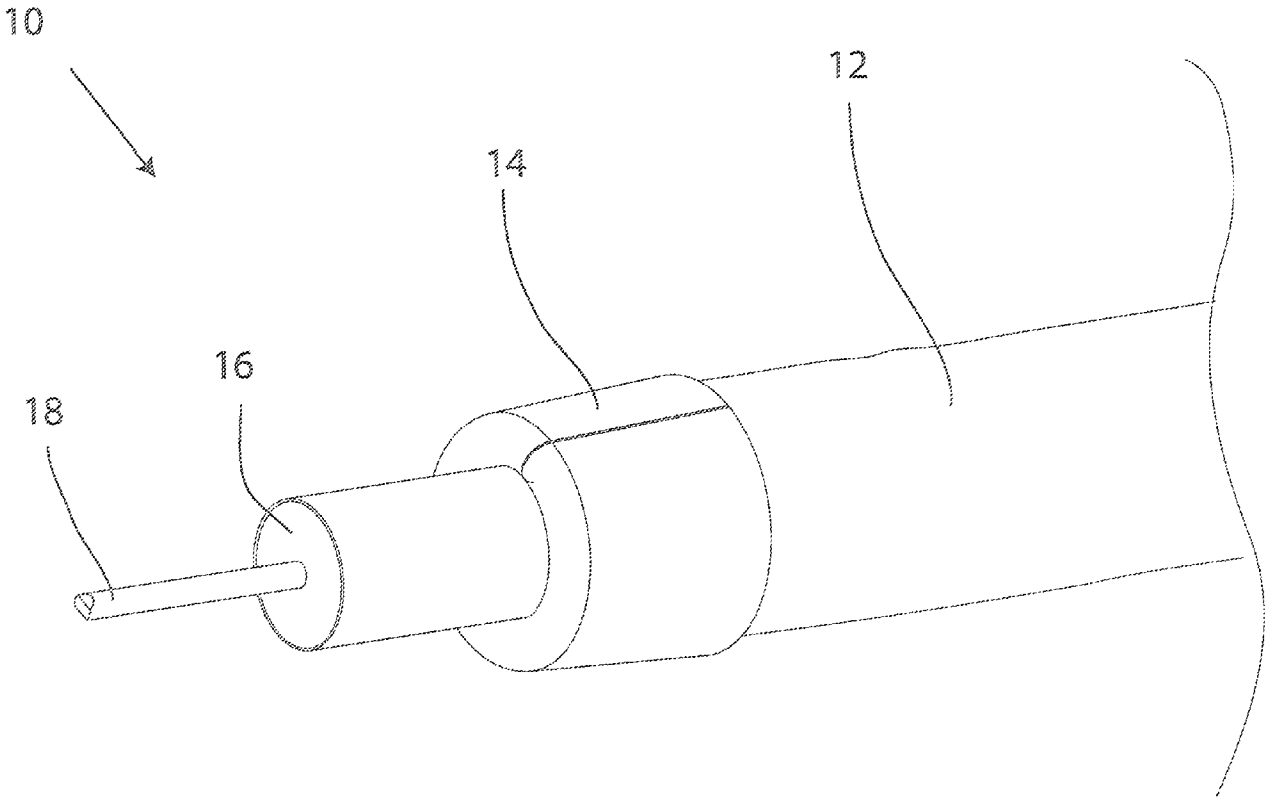
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to prevent ingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Furthermore, preventing environmental elements from contacting the dielectric 16 and the inside surface of a post 40 may be important to the longevity and efficiency of the coaxial cable 10. In addition to adversely affecting the efficiency and longevity of the cable 10, rain or similar environmental pollutants traveling down the cable 10 entering an electronic device, such as a television, can create a hazardous situation. For instance, water entering the connector and/or electronic device may cause a short circuit or other malfunction which can lead to an electrical fire. Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may enter the connector 100 if a coaxial cable connector is loosely connected to an interface port 20 located outdoors. Moreover, environmental contaminants may enter connector components via numerous potential means whenever the coaxial cable 10 and connector 100 are exposed to environmental elements. One path environmental elements may enter the connector 100 and come into contact with the dielectric 16 may be through the coupling element 30. For example, water, or any environmental element may enter the area within the coupling element 30 and continue towards the second end 42 of the post 40, and may seep through small openings between components of the connector to contact the dielectric 16 and/or the inside surface of the post 40 causing undesirable results and damage. A seal or a barrier may prevent environmental elements from entering the connector 100 and ultimately the dielectric 16 and/or the inside surface of the post 40 and may be formed by placing a seal member 70 proximate the dielectric 16 within the connector 100.

Figure 7:
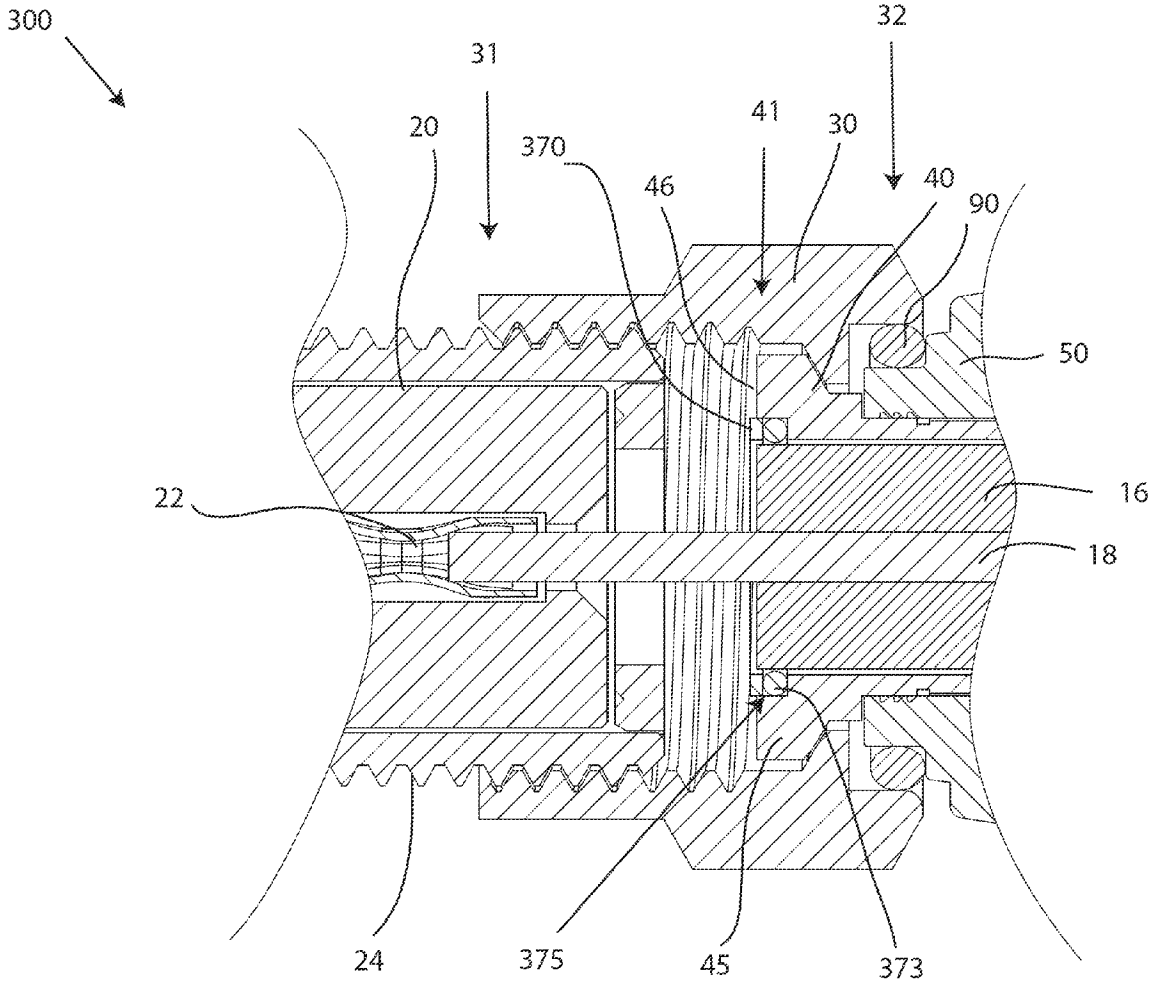
FIG. 7 depicts a cross-section view of the third embodiment of a coaxial cable connector having a seal member, partially mated with an interface port.

Referring back to FIG. 1, the connector 100 may mate with a coaxial cable interface port 20. The coaxial cable interface port 20 (as shown in FIG. 7) includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface 24 may be fabricated from a conductive material, while the material comprising the mating edge 26 may be non-conductive or vice versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling element 30, a connector body 50, a fastener member 60, a connector body conductive member, such as O-ring 90, and a seal member 70. Connector 100 may also include a conductive mating member, located proximate the first end 41 of the post 40, wherein the conductive member facilitates grounding of the coaxial cable.

Embodiments of connector 100 may include a post 40. The post 40 comprises a first end 41, a second end 42, an inner surface 43, and an outer surface 44. Furthermore, the post 40 may include a flange 45, such as an externally extending annular protrusion, located proximate or otherwise near the first end 41 of the post 40. The flange 45 may include an outer tapered surface facing the second end 42 of the post 40 (i.e. tapers inward toward the second end 42 from a larger diameter at the first end 41 to a smaller diameter. The outer tapered surface of the flange 45 may correspond to a tapered surface of the lip 36 of the coupling element 30. Further still, an embodiment of the post 40 may include a surface feature 49 such as a lip or protrusion that may engage a portion of a connector body 50 to secure axial movement of the post 40 relative to the connector body 50. However, the post may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge of an interface port 20. The post 40 should be formed such that portions of a prepared coaxial cable 10 including the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

With continued reference to FIG. 1, embodiments of connector 100 may include a coupling element 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the second end 32 and configured to hinder axial movement of the post 40. Furthermore, the coupling element 30 may comprise a cavity 38 extending axially from the edge of second end 32 and partial defined and bounded by the internal lip 36. The cavity 38 may also be partially defined and bounded by an outer internal wall 39. The coupling element 30 may be formed of conductive materials facilitating grounding through the coupling element, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various embodiments of the nut 30 may also comprise a coupler member, or coupling element, having no threads, but being dimensioned for operable connection to a corresponding interface port, such as interface port 20.

Referring still to FIG. 1, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the first end 51 of the body 50; the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the first end 51 of the connector body 50. Furthermore, the connector body 50 may include a semi-rigid, yet compliant outer surface 54, wherein the outer surface 54 may be configured to form an annular seal when the second end 52 is deformably compressed against a received coaxial cable 10 by operation of a fastener member 60. The connector body 50 may include an external annular detent located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61, second end 62, inner surface 63, and outer surface 64. In addition, the fastener member 60 may include an internal annular protrusion located proximate the first end 61 of the fastener member 60 and configured to mate and achieve purchase with an annular detent on the outer surface 55 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first diameter positioned proximate with the first end 61 of the fastener member 60 and a second opening or inner bore having a second diameter positioned proximate with the second end 62 of the fastener member 60. The ramped surface may act to deformably compress the outer surface 54 of the connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate or significantly close to the coupling element 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Further embodiments of connector 100 may include a connector body conductive member 90 proximate a first end 51 of a connector body 50. The connector body conductive member 90 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 90 may comprise a substantially circinate torus or toroid structure, or other ring-like structure. For example, an embodiment of the connector body conductive member 90 may be an O-ring configured to cooperate with the annular recess 56 proximate the first end 51 of connector body 50 and the cavity 38 extending axially from the edge of second end 32 and partially defined and bounded by an outer internal wall 39 of coupling element 30 such that the connector body conductive O-ring 90 may make contact with and/or reside contiguous with the annular recess 56 of connector body 50 and outer internal wall 39 of threaded nut 30 when attached to the post 40 of connector 100. The connector body conductive member 90 may facilitate an annular seal between the coupling element 30 and connector body 50 thereby providing a physical barrier to unwanted ingress of moisture and/or other environmental contaminates. Moreover, the connector body conductive member 90 may facilitate electrical coupling of the connector body 50 and coupling element 30 by extending therebetween an unbroken electrical circuit. In addition, the connector body conductive member 90 may facilitate grounding of the connector 100, and attached coaxial cable 10 (shown in FIG. 2), by extending the electrical connection between the connector body 50 and the coupling element 30. Furthermore, the connector body conductive member 90 may effectuate a buffer preventing ingress of electromagnetic noise between the coupling element 30 and the connector body 50. It should be recognized by those skilled in the relevant art that the connector body conductive member 90 may be manufactured by extruding, coating, molding, injecting, cutting, turning, elastomeric batch processing, vulcanizing, mixing, stamping, casting, and/or the like and/or any combination thereof in order to provide efficient production of the component.

Referring still to FIG. 1, embodiments of a coaxial cable connector 100 can include a seal member 70. The seal member 70 may be formed of a rubber polymer. Additional materials the seal member 70 may be formed of may include, but are not limited to, conductive polymers, plastics, conductive elastomers, elastomeric mixtures, composite materials having conductive properties, conductive rubber, and/or the like and/or any operable combination thereof. The seal member 70 may be a resilient, rigid, semi-rigid, flexible, or elastic member, component, element, and the like. To protect environmental pollutants from reaching the internals of connector 100, including the dielectric 16, the seal member 70 may be disposed around the dielectric 16, proximate the first end 41 of the post 40. In other words, the seal member 70 may be disposed proximate or otherwise near the flange 45 of the post 40 to form, create, erect, build, provide, etc. a barrier against environmental elements, thereby preventing environmental elements from entering the connector 100. The location of the seal member 70 may prevent external environmental elements such as moisture and rainwater from entering the connector 100, but does not impede the movement of the dielectric 16 (possibly surrounded by a foil layer) within the post 40, specifically towards the first end 41 of the post 40. Those skilled in the art would appreciate that the seal member 70 may be fabricated by extruding, coating, molding, injecting, cutting, turning, elastomeric batch processing, vulcanizing, mixing, stamping, casting, and/or the like and/or any combination thereof in order to provide efficient production of the component.

Moreover, the seal member 70 may be in physical communication or contact with the dielectric 16 (or possible foil layer generally surrounding the dielectric 16), which may prevent environmental elements from entering the connector 100, and or the cable 10. For example, when the dielectric 16 and center conductor 18 are proximate the first end 41 of the post 40, the dielectric 16 contacts the seal member 70. The coaxial cable 10 may be radially compressed to establish sufficient and adequate contact between the seal member 70 and the dielectric 16, as well as strengthening or tightening the physical contact between the post 40 and the seal member 70. However, adequate and continuous contact may be established and maintained by the placement of a seal member 70 proximate the first end 41 of the post 40 without the need to radially compress the connector 100. The physical communication or contact between the dielectric 16 and the seal member 70, and between the post 40, in particular, the flange 45 of the post, and the seal member 70 may create a seal or barrier against external environmental elements, such as moisture. For example, the adequate and continuous contact may keep environmental elements external to the connector 100, and/or post 40, dielectric 16, center conductor 18, and conductive strand 14.

Figure 3:
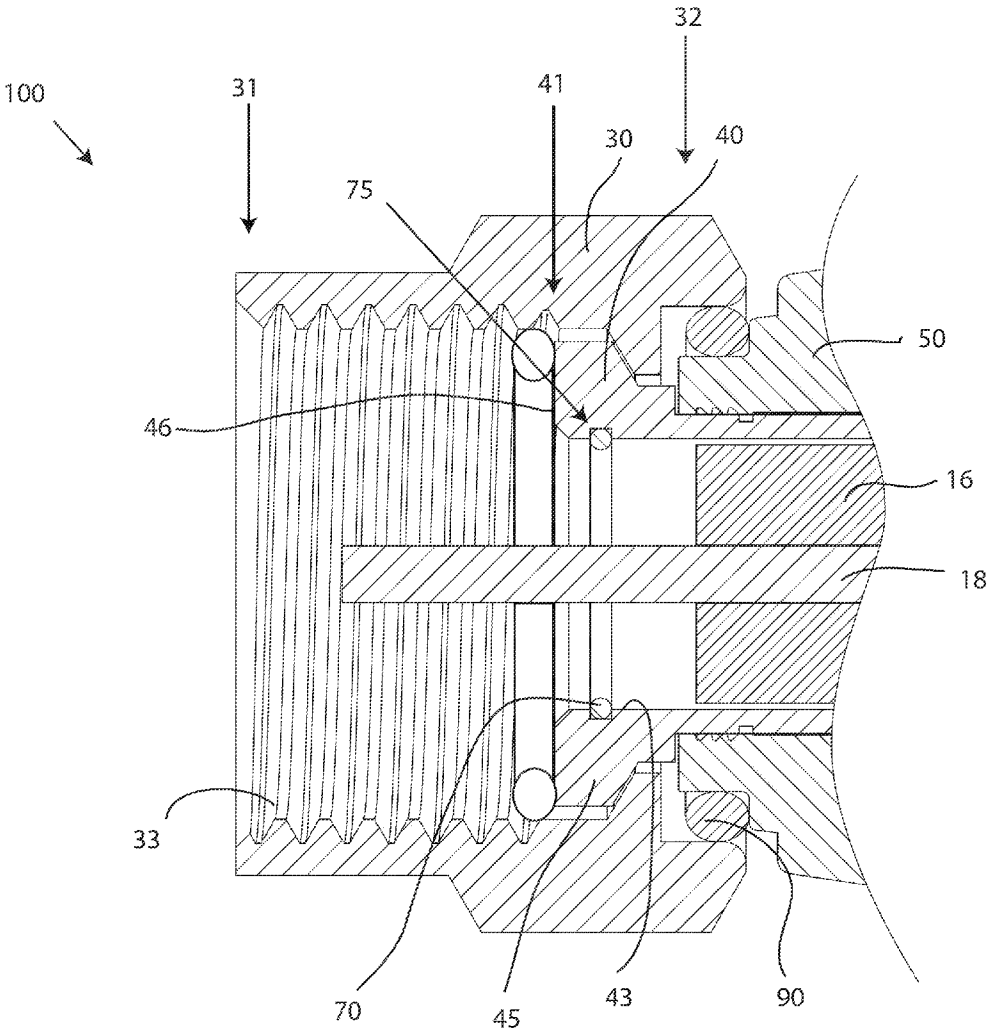
FIG. 3 depicts a cross-section view of the first embodiment of a coaxial cable connector having a seal member and a conductive mating edge member.

Referring specifically to FIGS. 1 and 3, embodiments of connector 100 may include a connector body 50 attached to a post 40, the post 40 having a first end 41, a second end 42, and a flange 45 proximate the first end 41, wherein the post 40 is configured to receive a center conductor 18 surrounded by a dielectric 16 of a coaxial cable 10, a port coupling element 30 attached to the post 40, and a seal member 70 disposed proximate the dielectric 16 to create a seal around the dielectric 16 to prevent entry of environmental elements. Further embodiments of connector 100 may include a connector body 50 attached to a post 40, the post having a first end 41, a second end 42, and a flange 45 proximate the first end 41, wherein the post 40 is configured to receive a center conductor 18 surrounded by a dielectric 16 of a coaxial cable 10, a port coupling element 30 attached to the post 40, and a seal member 70 integrated with the post 40 to create a seal between the seal member 70 and the dielectric 16, wherein the seal member 70 integrated with the post 40 is disposed substantially within an annular notch 75 along an inner surface 43 of the post 40, proximate the center of the flange 45 of the post 40.

Moreover, embodiments of connector 100 may include a seal member 70 integrated with the post 40. The seal member 70 being integrated with the post 40 may refer to the seal member 70 becoming a part of the post 40 or being unified with the post 40 by disposing the seal member 70 proximate, within, partially within, directly against, or compressed against, the post 40. For example, a seal member 70 may be disposed within or partially within the flange 45 of the post 40, wherein the post 40 includes an annular notch 75. The notch 75 in the post 40 may be a groove, channel, opening, tunnel, annular detent, annular cavity, and the like, and may have circular or curvilinear cross-section to correspond with a seal member 70 having a circular or curvilinear cross-section. For example, the seal member 70 may comprise a substantially circinate torus or toroid structure, or other ring-like structure. The notch 75 can be positioned an axial distance from the first end 41 of the post 40, such that the notch 75 is positioned proximate or otherwise near the center of the flange 45, and may radially extend outward from the inner surface 43 a certain distance to accommodate the dimensions, such as girth, of the torus seal member 70. The center of the flange 45 may be any point along the inner surface 43 of the post 40 from the mating edge 46 to the bottom of the tapered surface of the flange 45, but not flush with the mating edge 46. Moreover, the seal member 70 may be partially disposed in the notch 75 of the post 40. For example, a portion, or a first surface, of the seal member 70 may reside within the notch, while the other portion, or second surface, may maintain direct and continuous contact with the dielectric 16 providing a barrier against external environmental elements from entering the connector 100. Additionally, the post 40 may have more than one notch 75 to accommodate more than one seal member 70.

Figure 4:
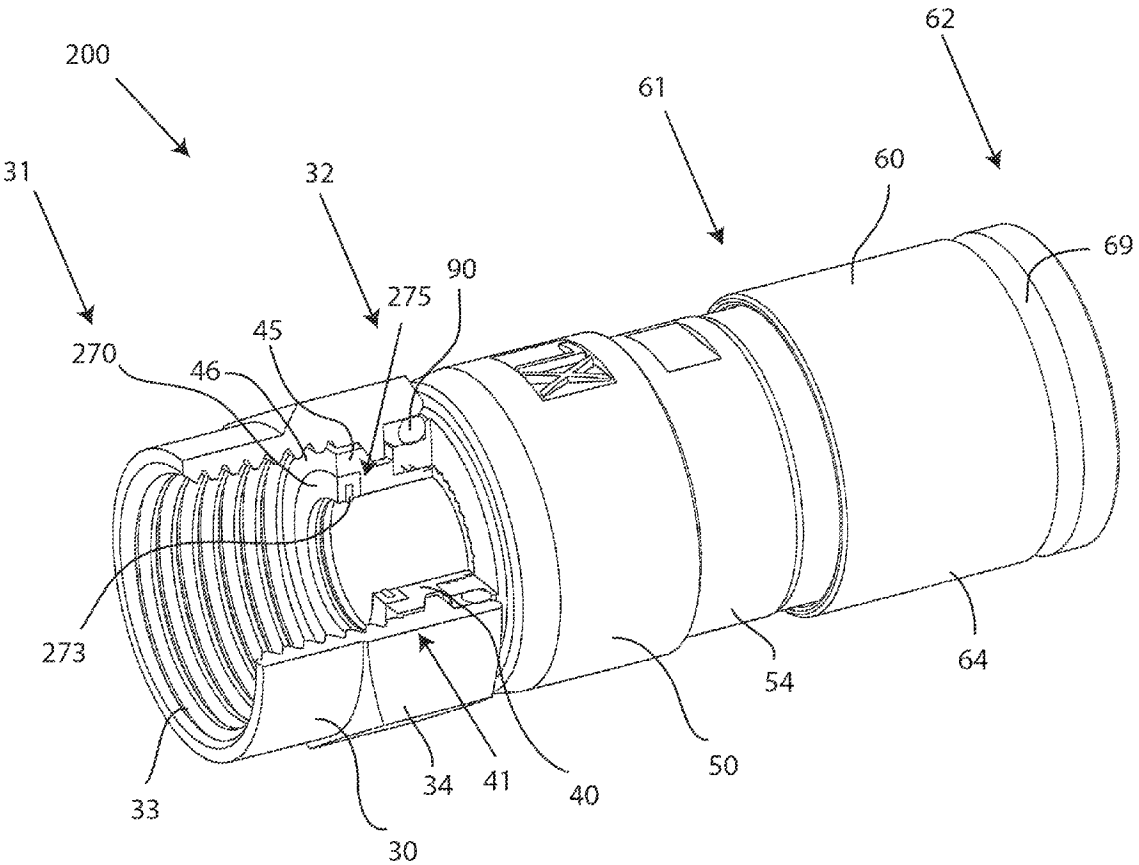
FIG. 4 depicts a perspective partial cut away view of a second embodiment of a coaxial cable connector having a seal member.
Figure 5:
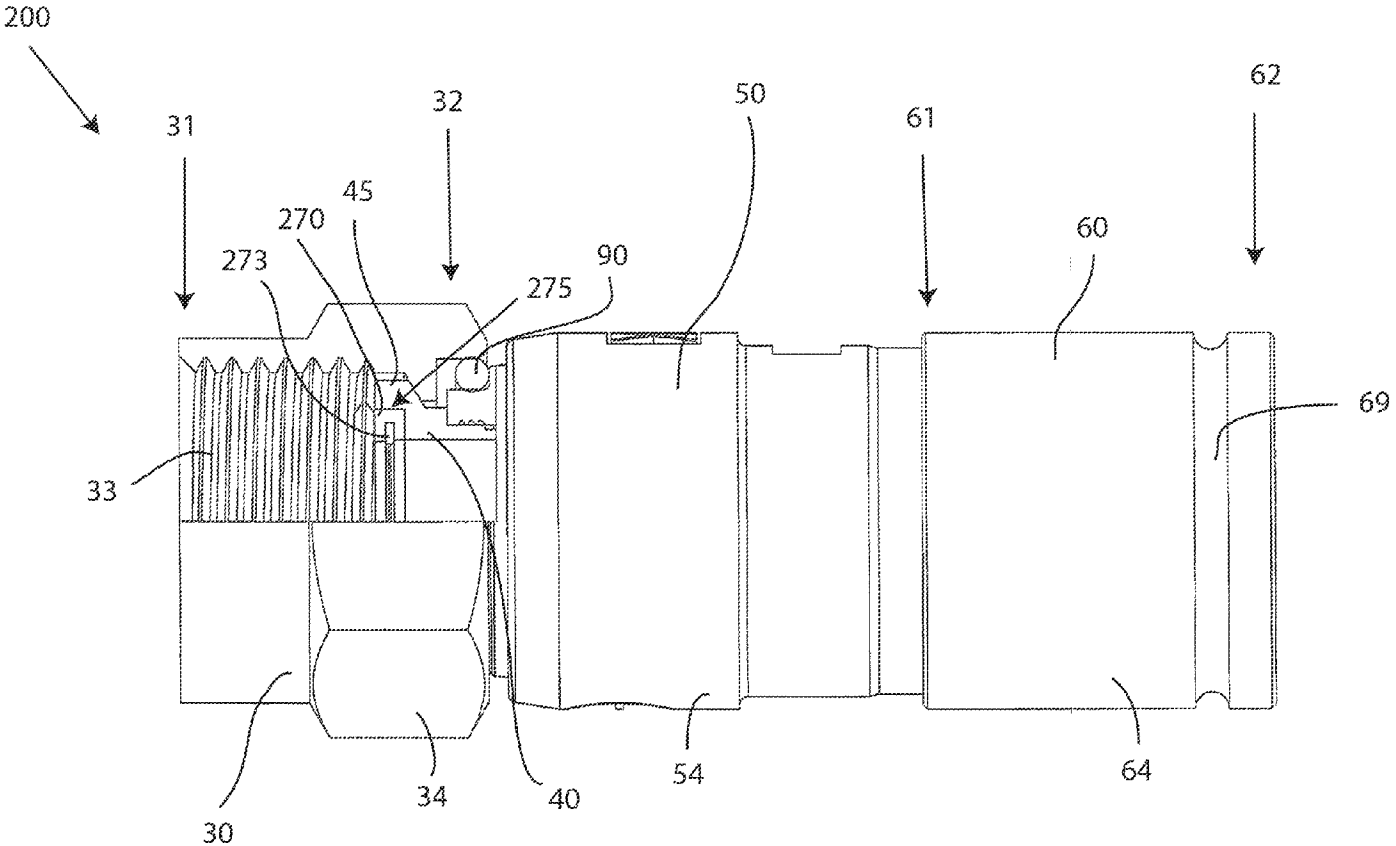
FIG. 5 depicts a partial cross-section view of the second embodiment of a coaxial cable connector having a seal member.

Referring still to the drawings, FIGS. 4 and 5 depict an embodiment of a coaxial cable connector 200 having a seal member 270. Moreover, the connector 200 may include a post 40, a coupling element 30, a connector body 50, a fastener member 60, a connector body conductive member 90, and a seal member 270. Embodiments of the post 40, coupling element 30, connector body 50, fastener member 60, and connector body conductive member 90 may be the same or substantially similar to the structure and function as provided for the embodiments associated with connector 100, and described supra. Additionally, the seal member 270 may share the same or substantially the same attributes and function as seal member 70, such as creating a seal within the cable 10 to prevent environmental pollutants from entering the connector 100 and/or the coaxial cable 10.

However, embodiments of connector 200 may include a connector body 50 attached to a post 40, the post having a first end 41, a second end 42, and a flange 45 proximate the first end 41, wherein the post 40 is configured to receive a center conductor 18 surrounded by a dielectric 16 of a coaxial cable 10, a port coupling element 30 attached to the post 40, and a seal member 270 disposed substantially within an annular notch 275 in the flange 45 of the post 40 to provide a barrier around the dielectric 16 to prevent ingress of environmental pollutants, wherein the seal member 270 is flush with a mating edge 46 of the post 40.

Moreover, connector 200 may include a seal member 270 integrated with the post 40 substantially flush with the mating edge 46 of the post 40. The seal member 270 being integrated with the post 40 may refer to the seal member 270 becoming a part of the post 40 or being unified with the post 40 by disposing the seal member 270 proximate, within, partially within, directly against, or compressed against, the post 40. For example, a seal member 270 may be disposed within or substantially within the flange 45 of the post 40, wherein the post 40 includes an annular notch 275. The notch 275 in the post 40 may be a groove, channel, opening, tunnel, annular detent, annular cavity, and the like, and may have a square or rectangular cross-section to correspond with a seal member 270 having a square or rectangular cross-section. For example, the seal member 270 may be a flat washer, or similar rectangular cross-sectioned ring-like structure. The notch 275 can be positioned immediately adjacent to or otherwise near the first end 41 of the post 40, such that the seal member 270 disposed within the notch 275 is flush or substantially flush with the mating edge 46 of the post 40, and the notch 275 may radially extend outward from the inner surface 43 a certain distance to accommodate the dimensions, such as girth, of the washer-type seal member 270. Moreover, the seal member 270 may be disposed in the notch 275 of the post 40, wherein an annular portion 273 of the seal member 70 may protrude from the notch 275, and maintaining direct and continuous contact with the dielectric 16 to provide a barrier against external environmental elements from entering the connector 200. The annular portion 273 of the seal member 270 may be structurally integral with the seal member 270 (i.e. a single, uniform component) or may be a separate component radially disposed within the seal member 270, having the same or substantially the same curvature as the seal member 270. Embodiments of seal member 270, while operably configured, may make physical contact with a port, such as interface port 20. Additionally, the post 40 may have more than one notch 275 to accommodate more than one seal member 270.

Figure 6:
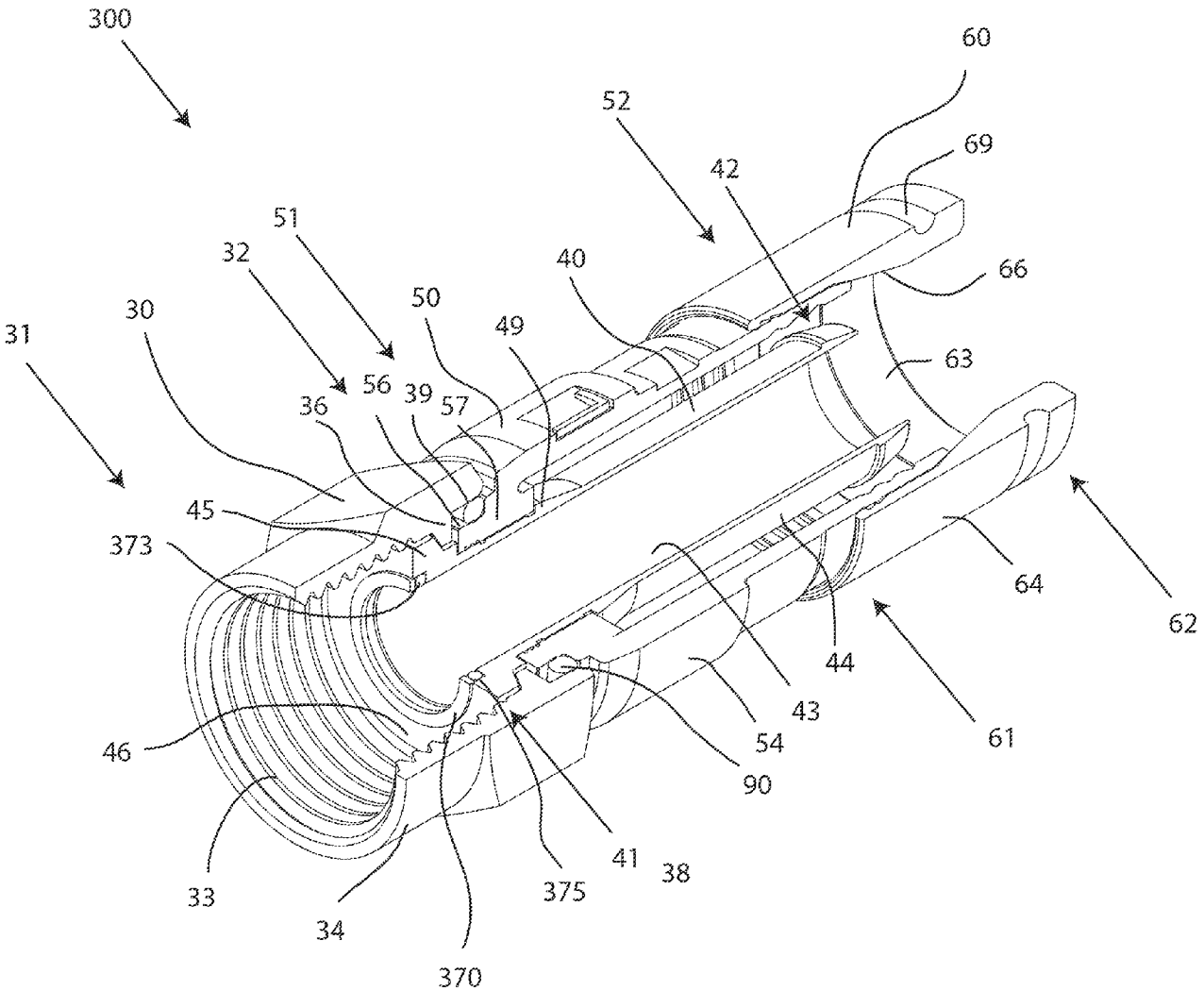
FIG. 6 depicts a perspective cut away view of a third embodiment of a coaxial cable connector having a seal member.
Figure 8:
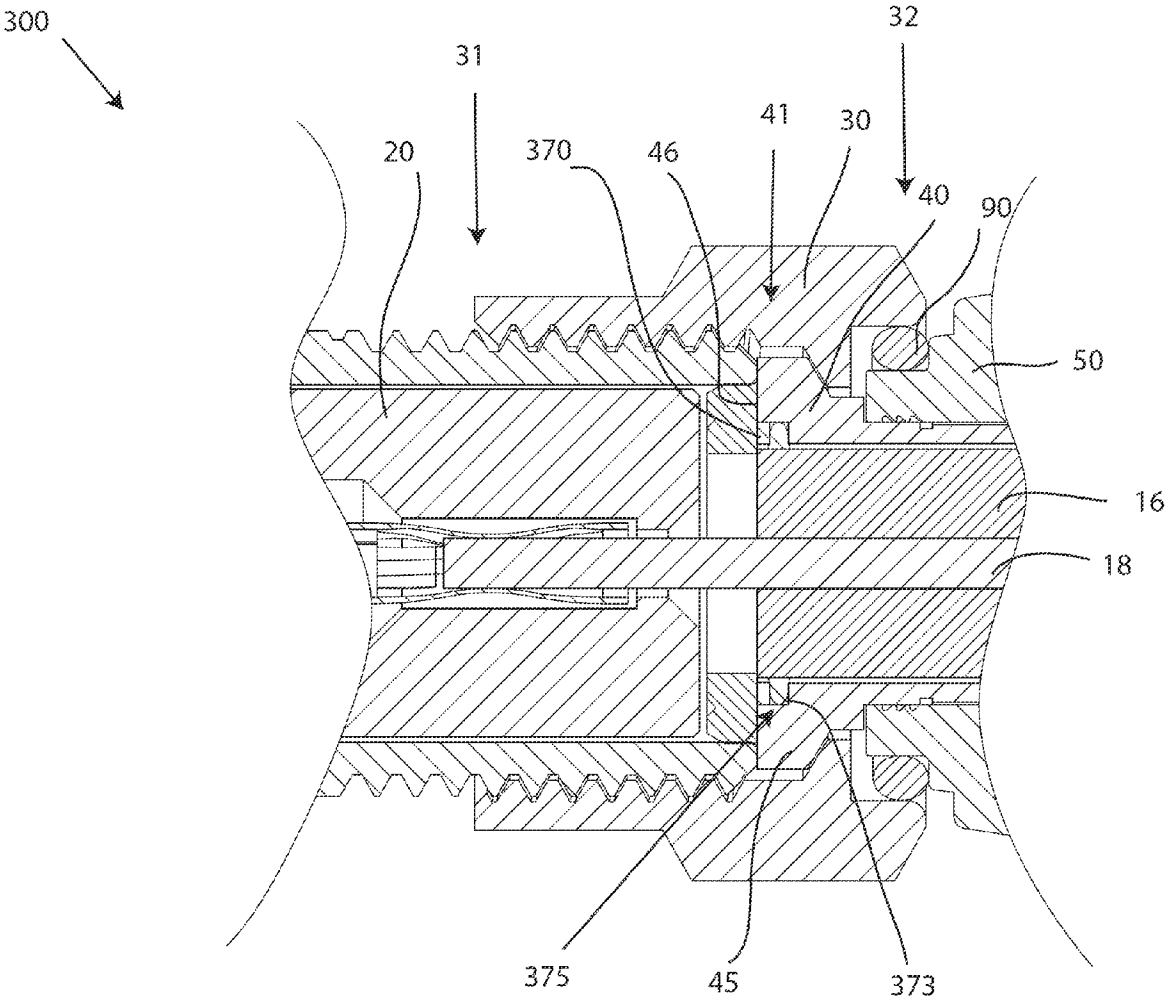
FIG. 8 depicts a cross-section view of the third embodiment of a coaxial cable connector having a seal member, mated with an interface port.

Referring now to FIGS. 6-8, an embodiment of a coaxial cable connector 300 having a plurality of seal members 370, 373 is shown. The connector 300 may include a post 40, a coupling element 30, a connector body 50, a fastener member 60, a connector body conductive member 90, and a plurality of seal member 370, 373. Embodiments of the post 40, coupling element 30, connector body 50, fastener member 60, and connector body conductive member 90 may be the same or substantially similar to the structure and function as provided for the embodiments associated with connector 100, and described supra. Additionally, the plurality of seal members 370, 373 may share the same or substantially the same attributes and function as seal member 70, such as creating a seal within the cable 10 to prevent environmental pollutants from entering the connector 300 and/or the coaxial cable 10.

However, embodiments of connector 300 may include a connector body 50 attached to a post 40, the post 40 having a first end 41, a second end 42, and a flange 45 proximate the first end 41, wherein the post 40 is configured to receive a center conductor 18 surrounded by a dielectric 16 of a coaxial cable 10, a port coupling element 30 attached to the post 40, a first seal member 370 disposed within an annular notch 375 in the flange 45 of the post 40, and a second seal member 373 disposed within the annular notch 375 in the flange 45 of the post 40, wherein the first seal member 370 and the second seal member 373 disposed within the annular notch 375 of the post 40 provide a barrier around the dielectric 16 to prevent ingress of environmental pollutants.

Moreover, connector 300 may include a plurality of seal members 370, 373 integrated with the post 40 to provide a barrier against environmental pollutants. The seal member 370 being integrated with the post 40 may refer to the seal member 370 becoming a part of the post 40 or being unified with the post 40 by disposing the seal member 370 proximate, within, partially within, directly against, or compressed against, the post 40. For example, a plurality of seal members 370, 373 may be disposed within or substantially within the flange 45 of the post 40, wherein the post 40 includes an annular notch 375. The notch 375 in the post 40 may be a groove, channel, opening, tunnel, annular detent, annular cavity, and the like, and may have square or rectangular cross-section. The notch 375 can be positioned immediately adjacent to or otherwise near the first end 41 of the post 40, such that at least one of a first and second seal member 370, 373 disposed within the notch 375 slightly protrudes from the mating edge 46 of the post 40 (as shown in FIG. 7), or is flush or substantially flush with the mating edge 46 (as depicted in FIG. 8). In addition, the notch 375 may radially extend outward from the inner surface 43 a certain distance to accommodate the dimensions, such as girth, of the seal members 370, 373. The plurality of seal members 370, 373 may include a first seal member 370, which can be a flat washer, or similar rectangular cross-sectioned ring-like structure, and a second seal member 373, which can be a substantially circinate torus or toroid structure, or other ring-like structure. However, the curvature of the first seal member 370 may match the curvature of the second seal member 373. Moreover, the plurality of seal members 370, 373 may be disposed in the notch 375 of the post 40, wherein the first seal member 370 rests atop the second seal member 373, while fitting or substantially fitting within the parameters of the notch 375 in the post 40. In another embodiment, the plurality of seal members 370, 373 may be disposed in the notch 375 of the post 40, wherein the second seal member 373 rests atop the first seal member 370, while fitting or substantially fitting within the parameters of the notch 375 in the post 40. However, as shown in FIG. 7, a portion of the first seal member 370 may protrude a distance from the mating edge 46 of the post 40, or may extend an axial distance from the first end 41 of the post 40 towards the generally axial opening of the coupling element 30. The portion of the combination of seal member 370, 373 extending from the post 40 may be further compressed by a mating interface port, such as interface port 20. Thus, the compressive forces acting on the seal members 370, 373 may help to maintain direct and continuous contact with the dielectric 16 to provide a barrier against external environmental elements from entering the connector 300. Additionally, the post 40 of connector 300 may have more than one notch 375 to accommodate more than one combination of seal members 370, 373.

Figure 9:
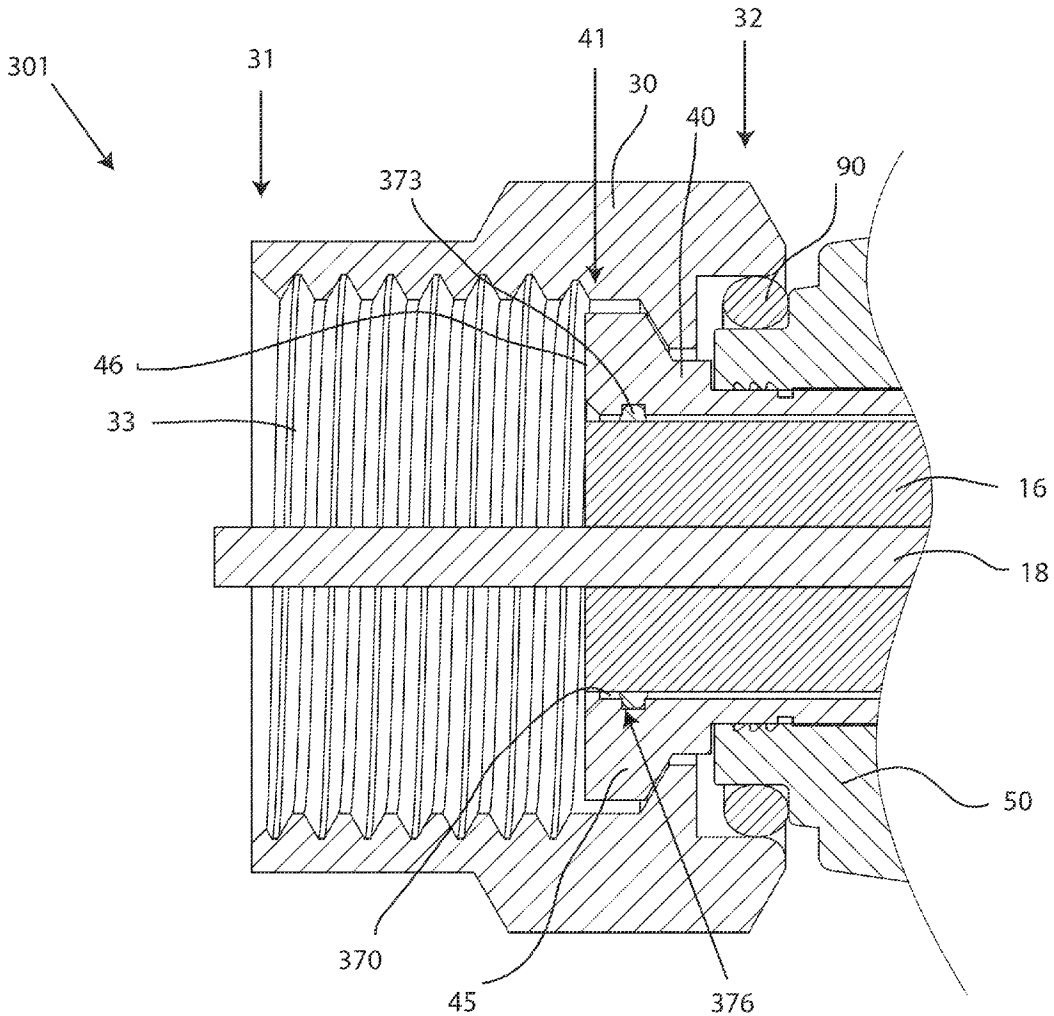
FIG. 9 depicts cross-section view of the third embodiment of a coaxial cable connector having a seal member.

With reference to FIG. 9, an embodiment of a coaxial cable connector 301 may share the same elements, function, and structure of connector 300; however, connector 301 includes a plurality of seal members 370, 373 disposed in a notch 376, wherein notch 376 has a step-configuration, and positioned a distance from the mating edge 46 of the post 40. For example, notch 376 may be located in the flange 45 of the post 40 between the mating edge 46 of the post 40 and the bottom of the tapered surface of the flange 45, but not flush with the mating edge 46. In other words, notch 376 may be located at any point along the inner surface 43 of the post 40 proximate or otherwise near the center of the flange 45. Moreover, notch 376 may include more than one annular notch to accommodate more than one seal member 370, 373. For example, notch 376 may include a first annular notch 377 and a second annular notch 378. The first annular notch 377 of notch 376 may be sized and dimensioned to accommodate the dimensions, such as girth, of the first seal members 370. Likewise, the second annular notch 378 may be sized and dimensioned to accommodate the dimensions, such as girth, of the second seal member 378; however, in most embodiments, both the first annular notch 377 and the second annular notch 378 have a rectangular cross-section. The first and second annular notch 377, 378 can be positioned proximate each other so as to form a single notch 376 which may receive one or more seal members 370, 373. Furthermore, the seal members 370, 373 disposed within notch 376 may physically contact the dielectric 16 (or possible foil layer) when a coaxial cable 10 is axially inserted into connector 301. For instance, the annular seal members 370, 373 may radially surround the dielectric 16 to provide a barrier against environmental pollutants. Additionally, the post 40 of connector 300 may have more than one notch 376 to accommodate more than one combination of seal members 370, 373.

Figure 10:
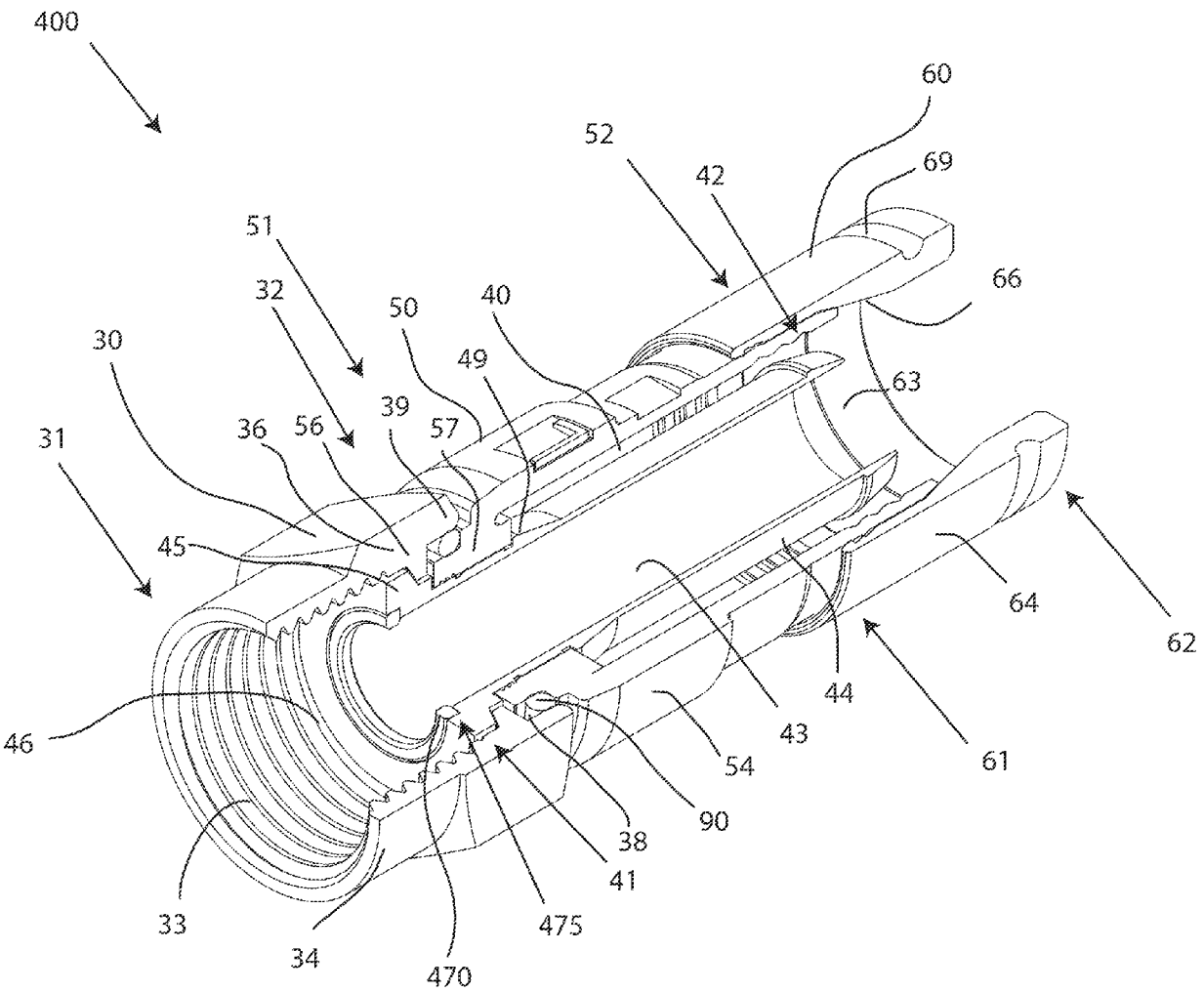
FIG. 10 depicts a perspective cut away view of a fourth embodiment of a coaxial cable connector having a seal member.
Figure 11:
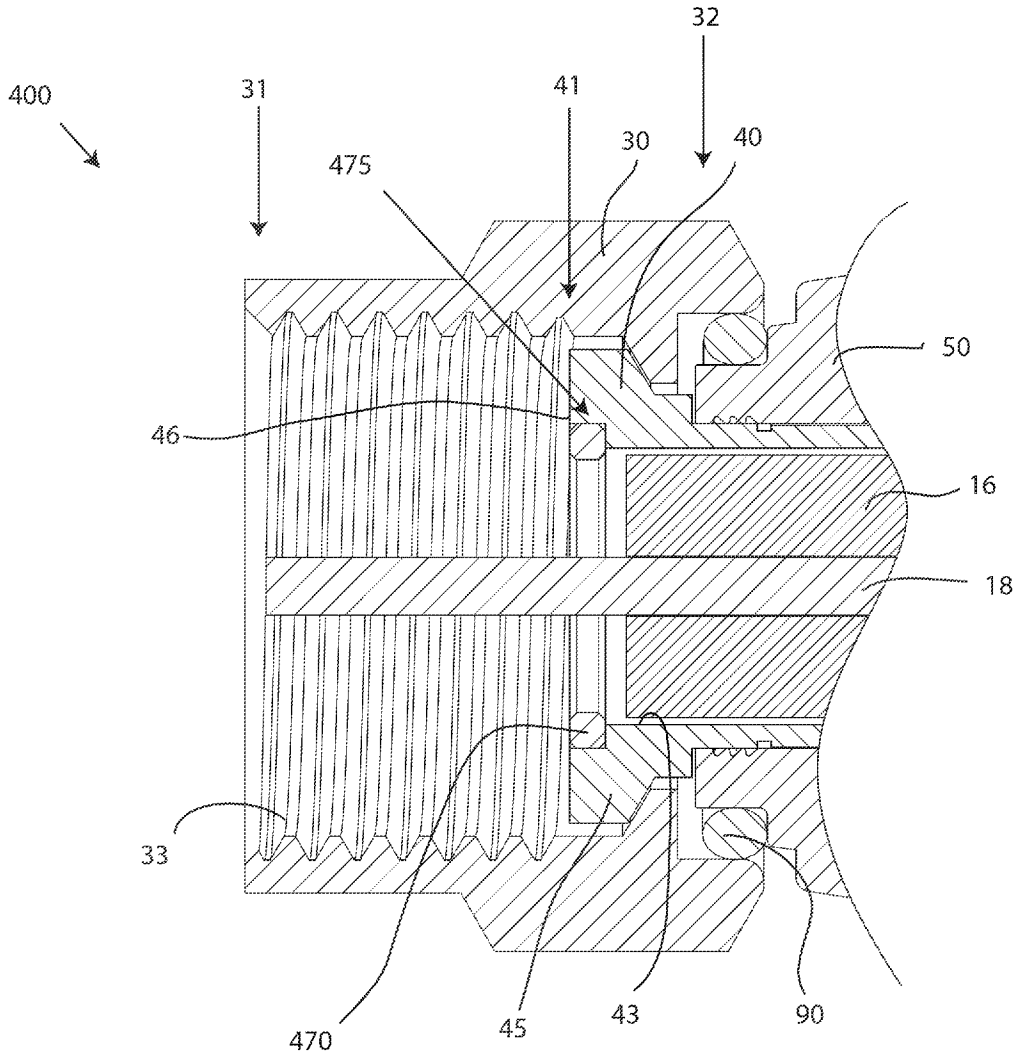
FIG. 11 depicts a cross-section view of the fourth embodiment of a coaxial cable connector having a seal member, wherein a coaxial cable is partially inserted.
Figure 12:
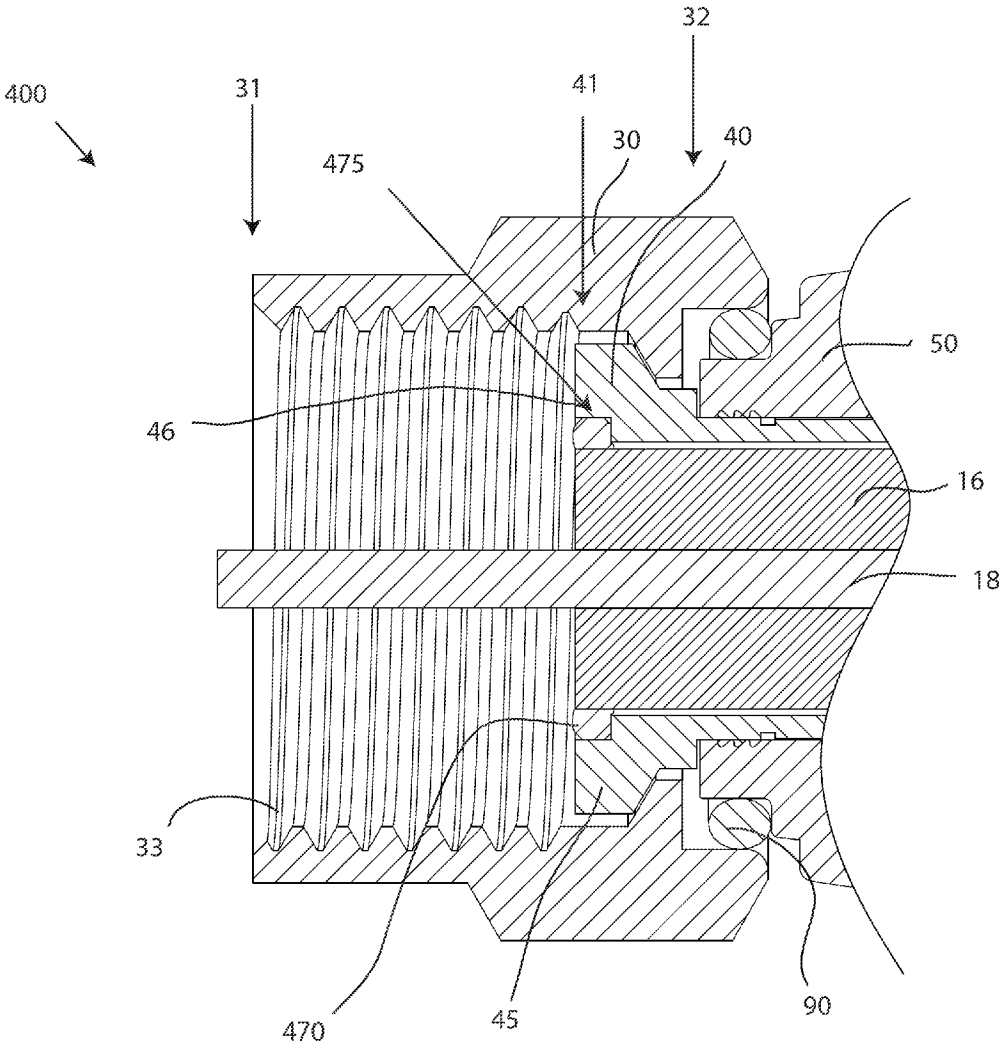
FIG. 12 depicts a cross-section view of the fourth embodiment of a coaxial cable connector having a seal member, wherein the coaxial cable is fully inserted.

Referring now to FIGS. 10-12, an embodiment of a coaxial cable connector 400 having a seal member 470 integrated with the post 40. The seal member 470 being integrated with the post 40 may refer to the seal member 470 becoming a part of the post 40 or being unified with the post 40 by disposing the seal member 470 proximate, within, partially within, directly against, or compressed against, the post 40. The connector 400 may include a post 40, a coupling element 30, a connector body 50, a fastener member 60, a connector body conductive member 90, and a seal member 470. Embodiments of the post 40, coupling element 30, connector body 50, fastener member 60, mating edge conductive member, and connector body conductive member 90 may be the same or substantially similar to the structure and function as provided for the embodiments associated with connector 100, and described supra. Additionally, the seal member 470 may share the same or substantially the same attributes and function as seal member 70, such as creating a seal within the cable 10 to prevent environmental pollutants from entering the connector 400 and/or the coaxial cable 10.

However, connector 400 may include a seal member 470 proximate the first end 41 of the post 40, the seal member 470 being substantially flush with the mating edge 46 of the post 40. For example, a seal member 470 may be disposed within or substantially within the flange 45 of the post 40, wherein the post 40 includes an annular notch 475. The notch 475 in the post 40 may be a groove, channel, opening, tunnel, annular detent, annular cavity, and the like, and may have square or rectangular cross-section. However, the seal member 470 may have a circular or curvilinear cross-section. For example, the seal member 270 may 70 may comprise a substantially circinate torus or toroid structure, or other ring-like structure. In one embodiment, the seal member 470 is a compression O-ring. In other embodiments, the annular seal member 470 may have a generally octagonal cross-section. The notch 475 can be positioned immediately adjacent to or otherwise near the first end 41 of the post 40, such that the seal member 470 disposed within the notch 475 is flush or substantially flush with the mating edge 46 of the post 40, and the notch 475 may radially extend outward from the inner surface 43 a certain distance to accommodate the dimensions, such as girth, of the compression-type seal member 470.

Moreover, the seal member 470 may be disposed in the notch 475 of the post 40, wherein a portion of the seal member 470 may protrude radially inward from the notch 475. For instance, a portion of the seal member 470 may extend a distance from the inner surface 43 of the post 40. The portion of the seal member 470 extending from the inner surface 43 of the post 40 may be further compressed by the incoming coaxial cable 10, in particular, the dielectric 16 (as shown in FIGS. 11 and 12). Thus, the compressive forces acting on the seal members 470 by the dielectric 16, proximate the first end 41 of the post 40, may help to maintain direct and continuous contact with the dielectric 16 to provide a barrier against external environmental elements from entering the connector 400. Furthermore, embodiments of seal member 470, while operably configured, may make physical contact with a port, such as interface port 20. Additionally, the post 40 of connector 400 may have more than one notch 475 to accommodate more than one seal member 470.

Figure 13:
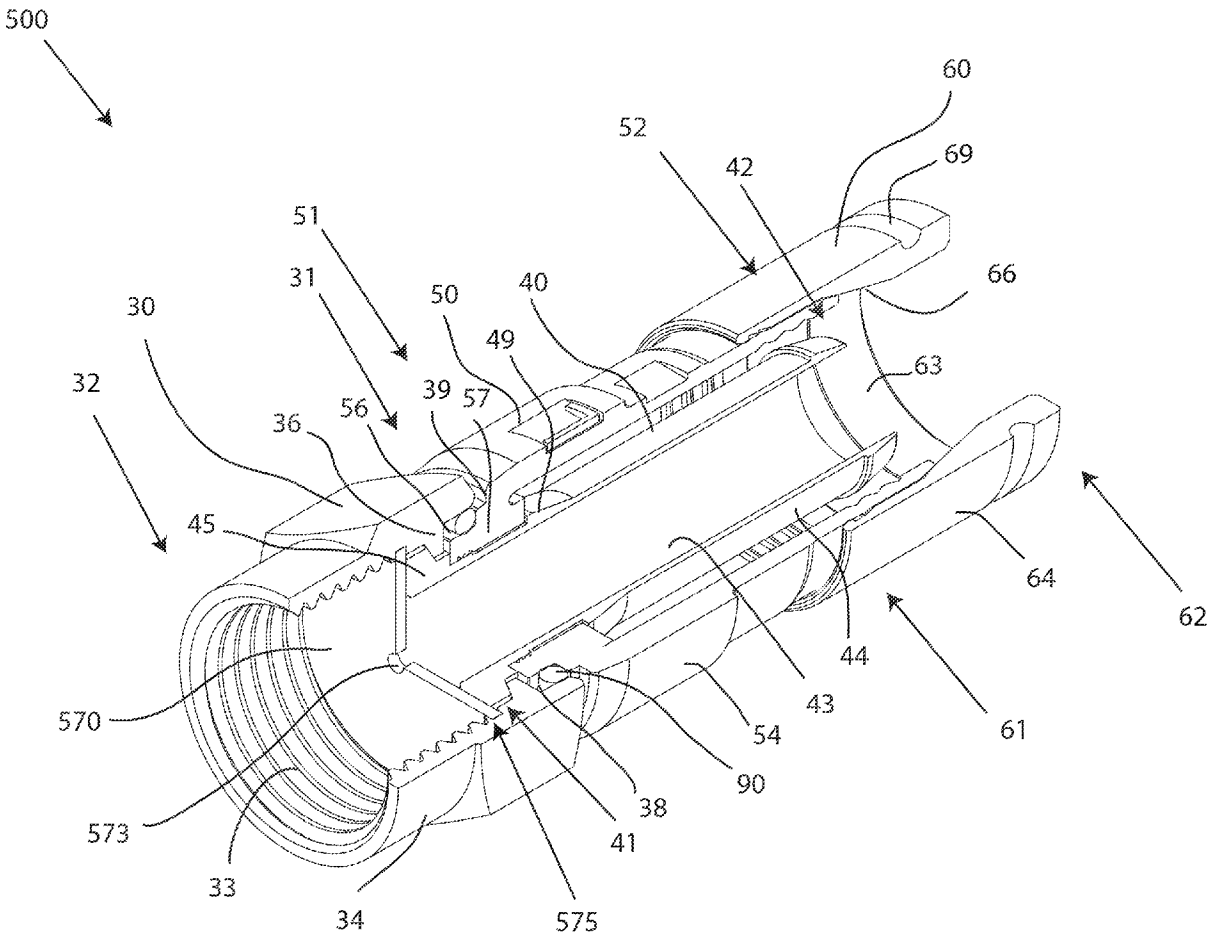
FIG. 13 depicts a perspective cut away view of a fifth embodiment of a coaxial cable connector having a seal member.
Figure 14:
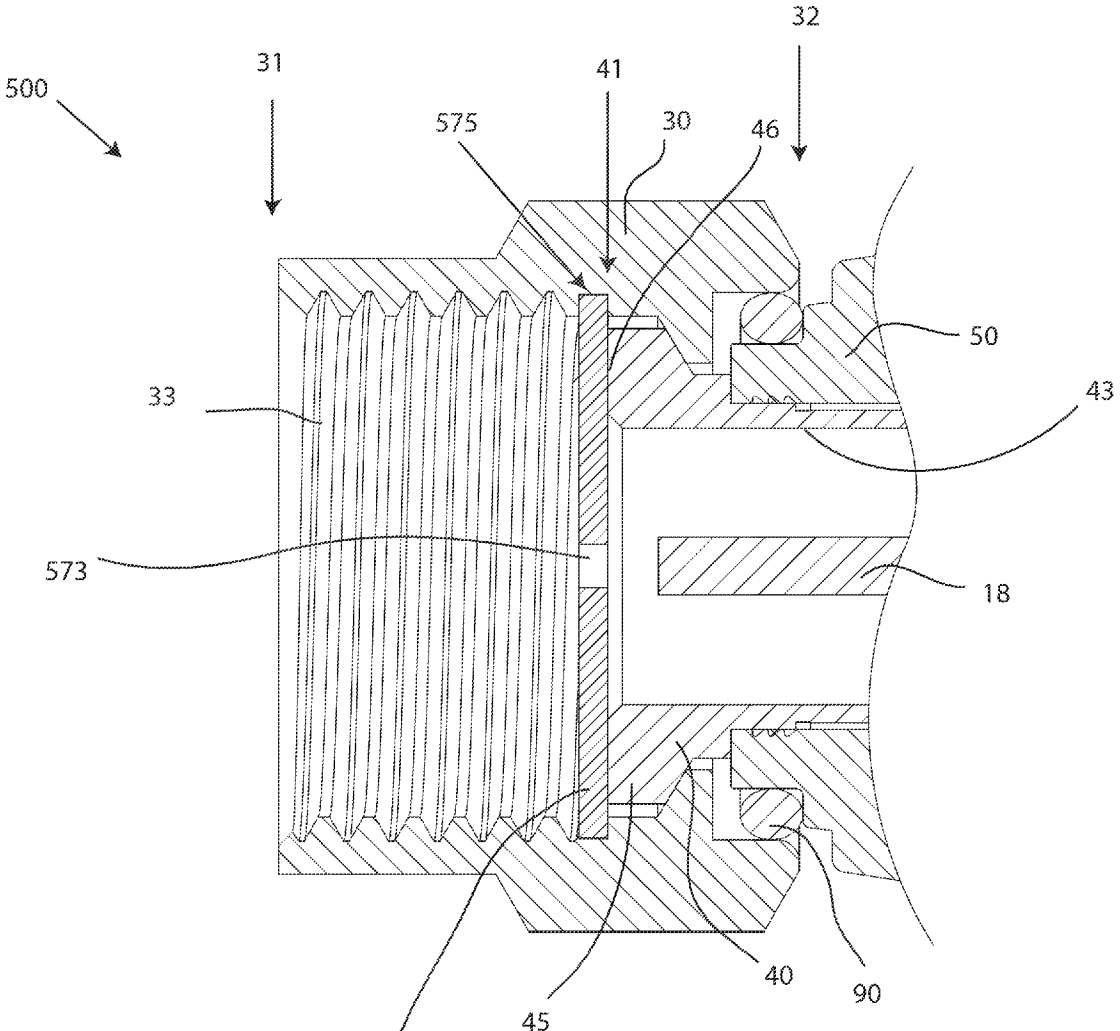
FIG. 14 depicts a cross-section view of the fifth embodiment of a coaxial cable connector having a seal member, wherein a coaxial cable is partially inserted.
Figure 15:
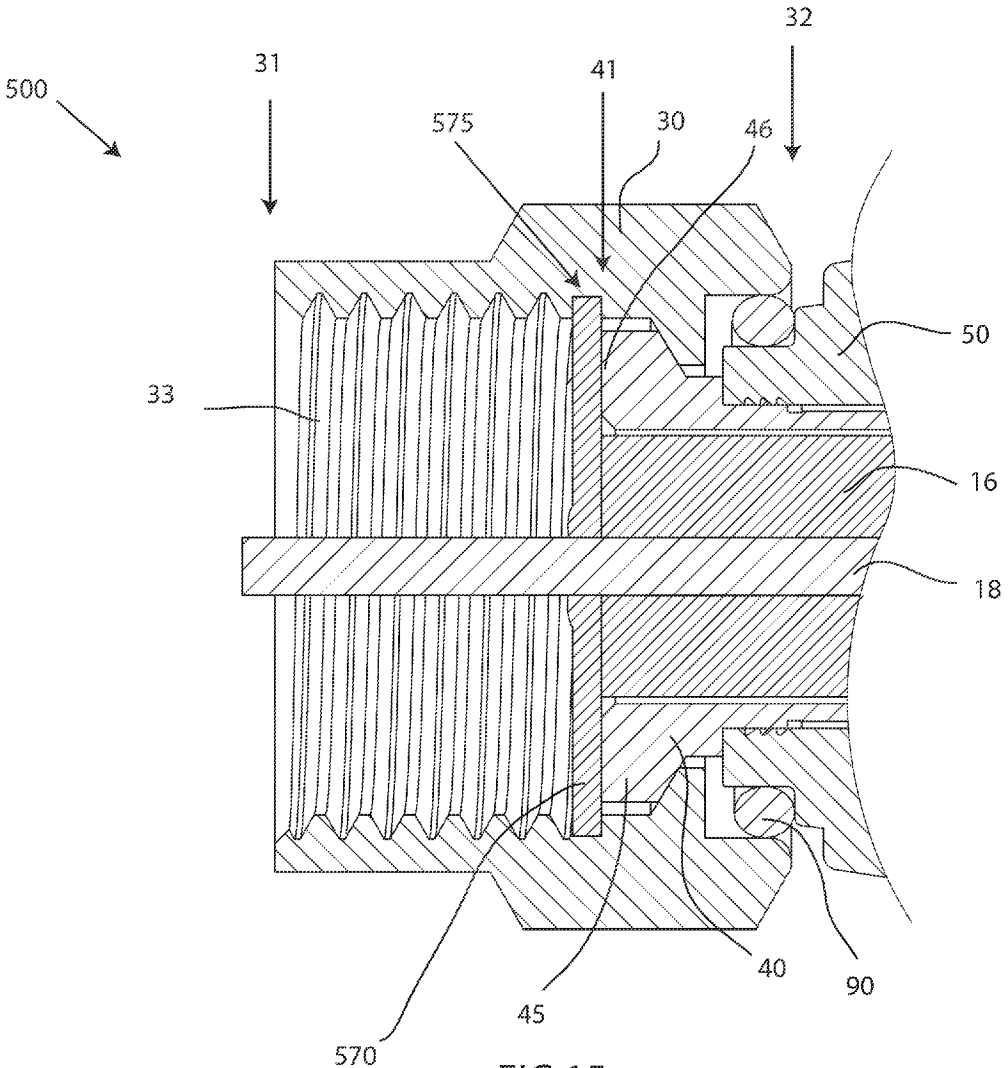
FIG. 15 depicts a cross-section view of the fifth embodiment of a coaxial cable connector having a seal member, wherein the coaxial cable is fully inserted.

Referring still to the drawings, FIGS. 13-15 depict an embodiment of a coaxial cable connector 500 having a seal member 570. The connector 500 may include a post 40, a coupling element 30, a connector body 50, a fastener member 60, a connector body conductive member 90, and a seal member 570. Embodiments of the post 40, coupling element 30, connector body 50, fastener member 60, and connector body conductive member 90 may be the same or substantially similar to the structure and function as provided for the embodiments associated with connector 100, and described supra. Additionally, the seal member 570 may share the same or substantially the same attributes and function as seal member 70, such as creating a seal within the cable 10 to prevent environmental pollutants from entering the connector 500 and/or coaxial cable 10.

However, embodiments of connector 500 may include a connector body 50 attached to a post 40, the post 40 having a first end 41, a second end 42, and a flange 45 proximate the first end 41, wherein the post 40 is configured to receive a center conductor 18 surrounded by a dielectric 16 of a coaxial cable 10, a port coupling element 30 attached to the post 40, the port coupling element 40 having an annular notch 575 located along an inner surface 33 of the port coupling element 30, and a seal member 570 disposed within a generally axial opening of the port coupling element 30 to prevent ingress of environmental pollutants, wherein an outer edge of the seal member 570 is disposed within the annular notch 575.

Moreover, embodiments of connector 500 may include a seal member 570 disposed within the coupling element 30. For example, a seal member 570 may be disposed proximate or otherwise near the first end 41 of the post 40. Embodiments of connector 500 include a coupling element 30 which may have annular notch 575 positioned along the inner surface 33 of the coupling element 30. The notch 575 in the coupling element may be a groove, channel, opening, tunnel, annular detent, annular cavity, and the like, and may have square, rectangular, circular, or curvilinear cross-section to correspond with a seal member 570 having a square, rectangular, circular, or curvilinear cross-section. The notch 575 can be positioned proximate or otherwise near the annular lip 36 of the coupling element 30. Typically, the annular notch 575 is located between the internal lip 36 and the threads of the inner surface 33 of the coupling element 30. The position of the annular notch 575 may also correspond to the location of the first end 41 of the post 40 when the connector 500 is operably assembled. For example, the outer edges of the seal member 570 may be disposed within the notch 575 to prevent movement, axial or otherwise, within the coupling element 30. The seal member 570 disposed within the generally axial opening of the port coupling element 30 should physically contact the mating edge 46 of the post 40 and the dielectric 16 of the coaxial cable 10. Thus, the seal member 570 may create a barrier starting from the notch 575 in the coupling element 30 and radially inward across the post 40 and the dielectric 16 to the opening 573, wherein the center conductor 18 passes axially through an opening 573 in the seal member 570 to extend the barrier. Moreover, the notch 575 may radially extend outward from the inner surface 33 of the coupling element 30 a certain distance to accommodate the dimensions, such as girth, of the washer-type seal member 570. Embodiments of seal member 570, while operably configured, may make physical contact with a port, such as interface port 20. Additionally, the coupling element 30 may have more than one notch 575 to accommodate more than one seal member 570.

Furthermore, the seal member 570 may be a flat washer having a small opening in the center, or similar rectangular or curvilinear cross-sectioned ring-like structure. Specifically, seal member 570 may have a first diameter, $d_1$, and a second diameter, $d_2$. The second diameter, $d_2$, may measure, reflect, represent, etc. the size of an opening 573 in the seal member 570. The size of opening 573 should correspond with an incoming center conductor 18 of a coaxial cable 10. For instance, the size of the opening 573, or the size of the second diameter, $d_2$, should be slightly larger than the size, including circumference and diameter, of the center conductor 18 of a coaxial cable 10. In most embodiments, the opening 573 is located in the center of the seal member 570; however, the location of the opening 573 should correspond to the location where the center conductor 18 axially extends or passes through. When the coaxial cable 10 is fully inserted into the connector 500, as shown in FIG. 15, the center conductor 18 may pass axially through the opening 573 of the seal member 570 with an extremely tight tolerance between the two components, so as to provide a barrier against environmental pollutants. In embodiments where the seal member 570 is formed of a rubber or similar resilient or flexible material, the opening 573 of the seal member 570 may be slightly smaller than the center conductor 18 so that when the center conductor 18 passes axially through the opening 573, portions of the seal member 570 proximate or otherwise near the opening 573 may deflect (as shown in FIG. 15). The deflection of portions of the seal member 570 may create a constant contact force against the center conductor 18 to establish and maintain continuous firm physical contact between the seal member 570 and the center conductor 18 to provide an efficient barrier against environmental pollutants.

Figure 16:
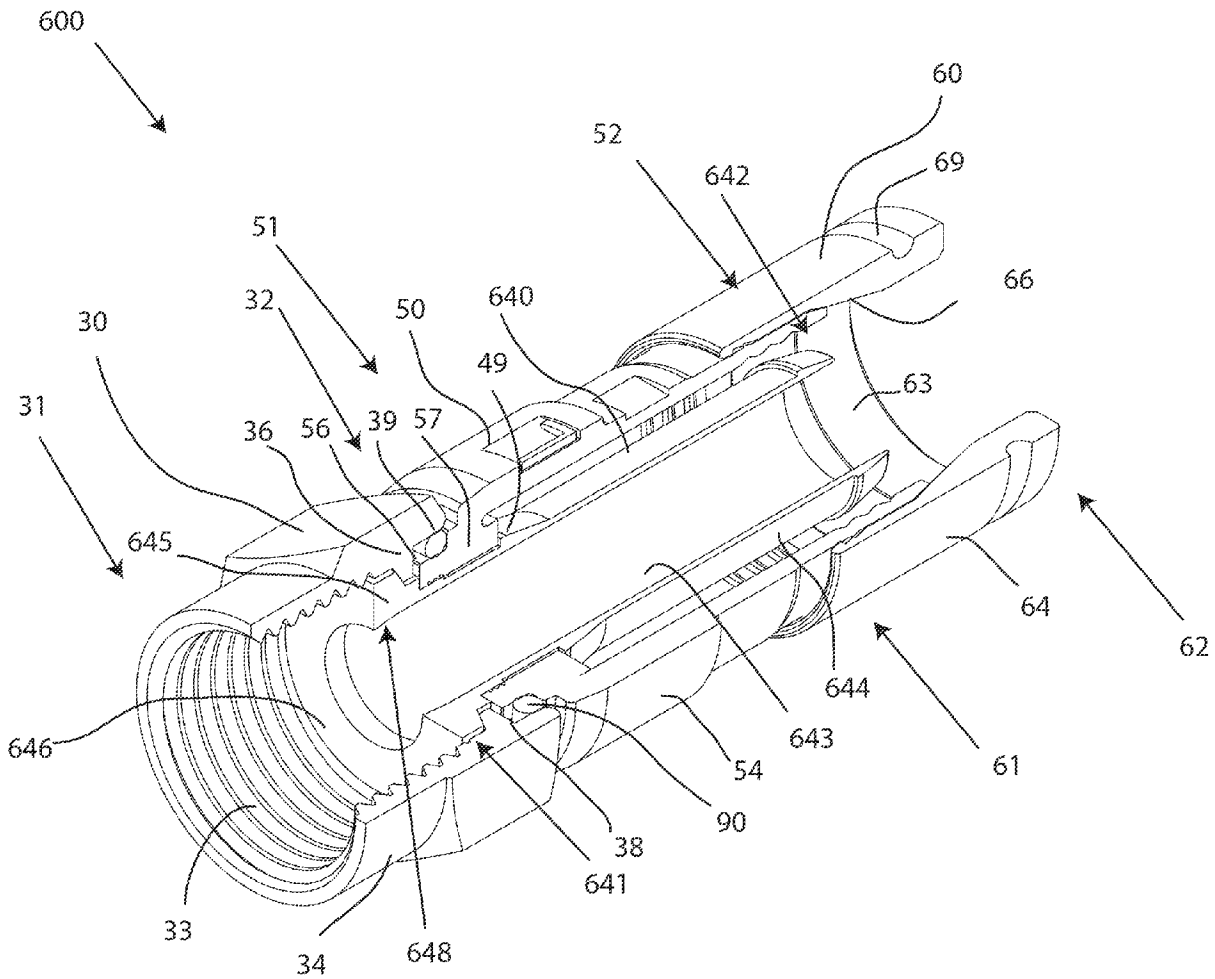
FIG. 16 depicts a perspective cut away view of a sixth embodiment of a coaxial cable connector having a post with an internally tapered surface.
Figure 17:
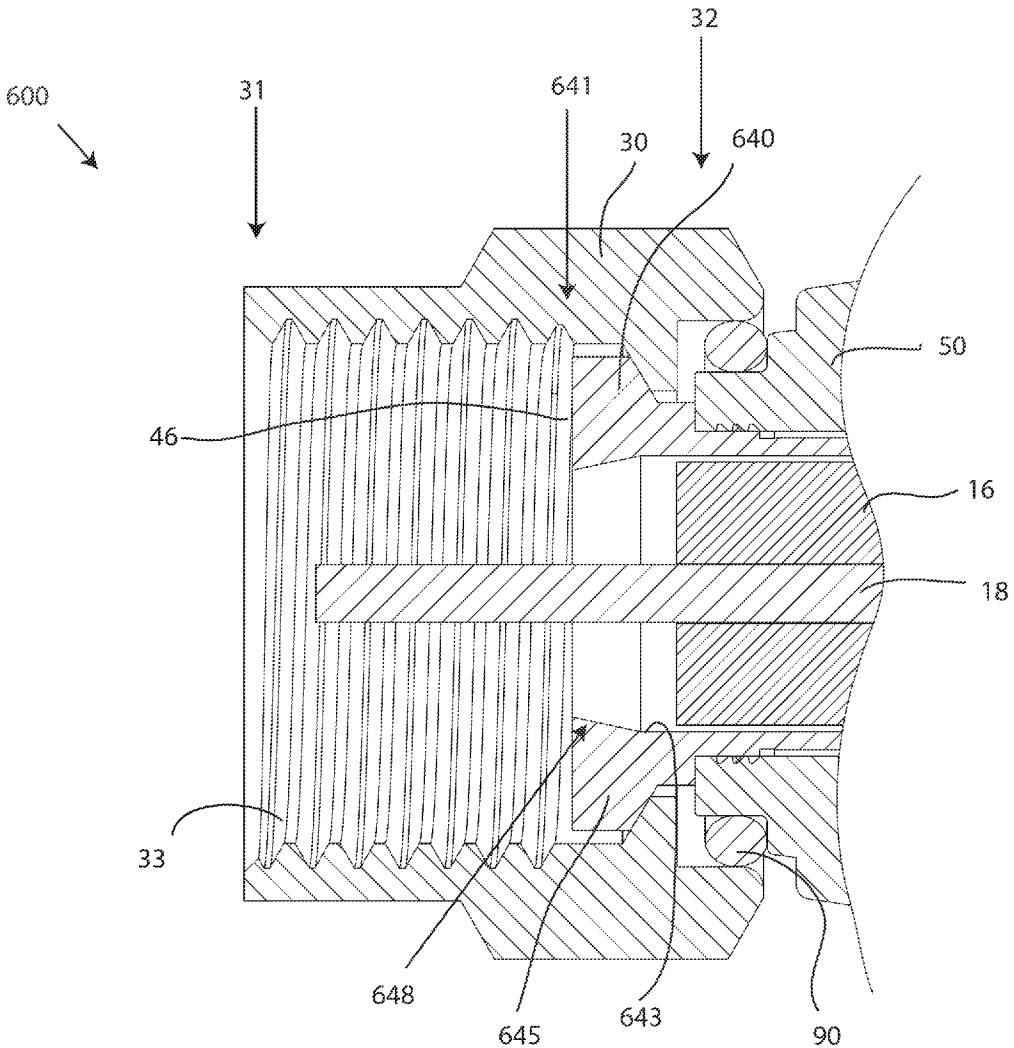
FIG. 17 depicts a cross-section view of the sixth embodiment of a coaxial cable connector having a post with an internally tapered surface, wherein the coaxial cable is partially inserted.
Figure 18:
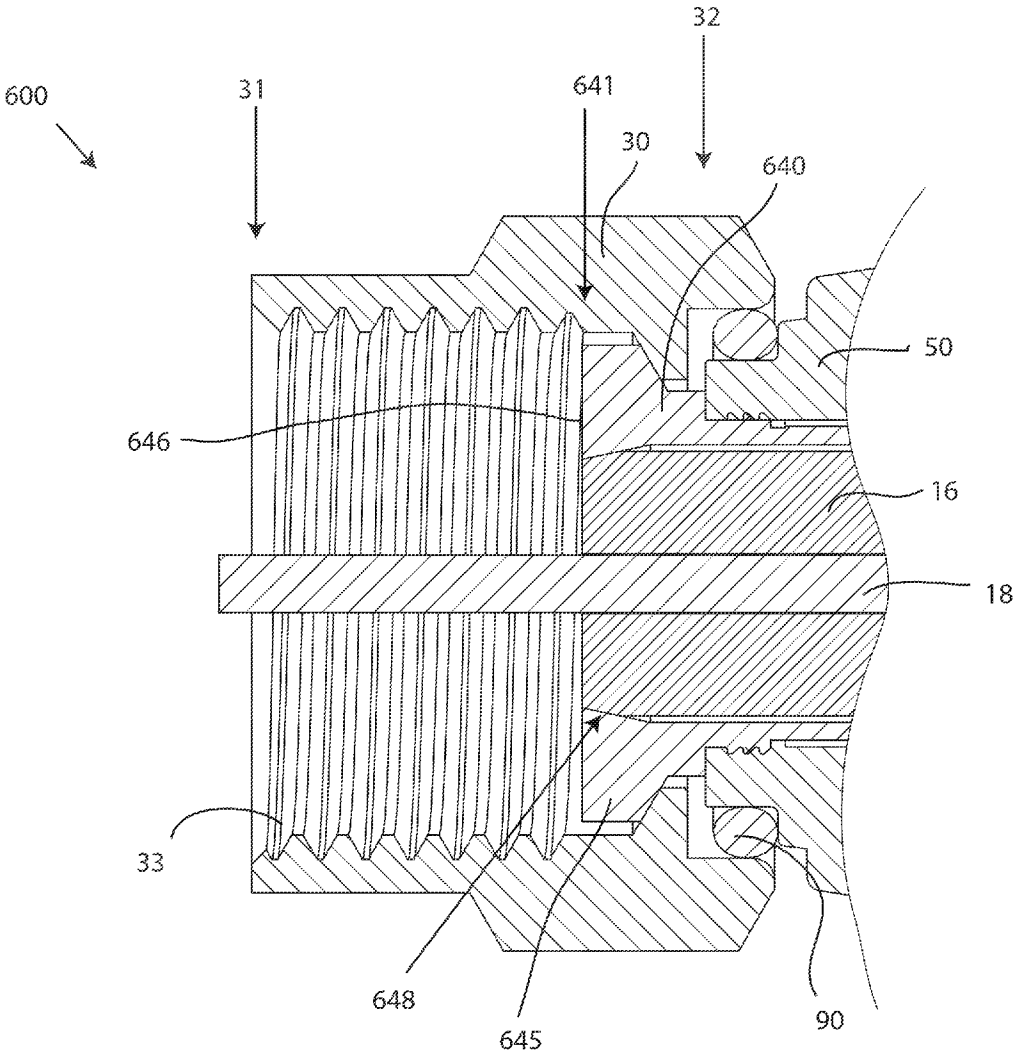
FIG. 18 depicts a cross-section view of the sixth embodiment of a coaxial cable connector having a post with an internally tapered surface, wherein the coaxial cable is fully inserted.

With reference now to FIGS. 16-18, embodiments of a coaxial cable connector 600 may include a coupling element 30, a connector body 50, a fastener member 60, a connector body conductive member 90, and a post 640. Embodiments coupling element 30, connector body 50, fastener member 60, and connector body conductive member 90 may be the same or substantially similar to the structure and function as provided for the embodiments associated with connector 100, and described supra.

However, embodiments of connector 600 may include a connector body 50 attached to a post 640, the post 640 having a first end 641, a second end 642, and a flange 645 proximate the first end 641, wherein the post 640 is configured to receive a center conductor 18 surrounded by a dielectric 16 of a coaxial cable 10, and a port coupling element 30 attached to the post 640, wherein the post 640 has an internally tapered surface 648 proximate the first end 641, the internally tapered surface 648 tapering radially inward toward the first end 641 to compress the dielectric 16 to form a seal around the dielectric 16.

Moreover, connector 600 may include a post 640 having an internally tapered surface 648 to create a seal around the dielectric 16, or, in other words, between the post 640 and dielectric 16 (or possible foil layer surrounding the dielectric 16). The post 640 may include a first end 641, a second end 642, an inner surface 643, and an outer surface 644. Furthermore, the post 640 may include a flange 645, such as an externally extending annular protrusion, located proximate or otherwise near the second end 642 of the post 640. The flange 645 may include an outer tapered surface facing the second end 642 of the post 640 (i.e. tapers inward toward the second end 642 from a larger diameter at the first end 641 to a smaller diameter. The outer tapered surface of the flange 645 may correspond to a tapered surface of the lip 36 of the coupling element 30. Further still, an embodiment of the post 640 may include a surface feature such as a lip or protrusion that may engage a portion of a connector body 50 to secure axial movement of the post 640 relative to the connector body 50. However, the post may not include such a surface feature, and the coaxial cable connector 600 may rely on press-fitting and friction-fitting forces and/or other component structures to help retain the post 640 in secure location both axially and rotationally relative to the connector body 50. The location proximate or otherwise near where the connector body 50 is secured relative to the post 640 may include surface features, such as ridges, grooves, protrusions, or knurling, which may enhance the secure location of the post 40 with respect to the connector body 50. Additionally, the post 640 includes a mating edge 646, which may be configured to make physical and electrical contact with a corresponding mating edge of an interface port 20. The post 640 should be formed such that portions of a prepared coaxial cable 10 including the dielectric 16 and center conductor 18 can pass axially into the second end 642 and/or through a portion of the tube-like body of the post 640. Moreover, the post 640 should be dimensioned such that the post 640 may be inserted into an end of the prepared coaxial cable 10, around the dielectric 16 and under the protective outer jacket 12 and conductive grounding shield or strand 14. Accordingly, where an embodiment of the post 640 may be inserted into an end of the prepared coaxial cable 10 under the drawn back conductive strand 14, substantial physical and/or electrical contact with the strand layer 14 may be accomplished thereby facilitating grounding through the post 640. The post 640 may be formed of metals or other conductive materials that would facilitate a rigidly formed post body. In addition, the post 640 may be formed of a combination of both conductive and non-conductive materials. For example, a metal coating or layer may be applied to a polymer of other non-conductive material. Manufacture of the post 640 may include casting, extruding, cutting, turning, drilling, knurling, injection molding, spraying, blow molding, component overmolding, or other fabrication methods that may provide efficient production of the component.

Furthermore, post 640 may include an internally tapered surface 648 proximate the first end 641 of the post 640. The internal tapered surface 648 may taper radially inward towards the first end 641 of the post 640 to evenly decrease the inner diameter of the post 640 proximate the first end 641. As a coaxial cable 10 is axially inserted into the second end 642 of the post 640 and passes through the generally cylindrical body toward the first end 641 of the post 640, the internally tapered surface 648 will increasingly apply pressure to, or compress squeeze the dielectric 16 of the coaxial cable 10. As the coaxial cable 10 is being axially inserted into connector 600, the physical contact between the internally tapered surface 348 and the dielectric 16 is strengthened as the center conductor 18 and the dielectric 16 move closer to the first end 41 of the post 640. For instance, the compression forces exerted onto dielectric 16 by the narrowing geometry of the internally tapered surface 648 create a seal around the dielectric 16 (or possible foil layer surrounding the dielectric 16).

Referring now to FIGS. 1-16, embodiments of a method of creating a seal around a dielectric 16 of a coaxial cable 10 may include the steps of providing a connector 100, 200, 300, 301, 400, 500 including: a connector body 50 attached to a post 40, the post 40 having a first end 41, a second end 41, and a flange 45 proximate the first end 41, wherein the post 40 is configured to receive a center conductor 18 surrounded by a dielectric 16 of a coaxial cable 10, and a port coupling element 30 attached to the post 40; disposing a seal member 70, 270, 370, 373, 470, 570 proximate the first end 41 of the post 40 to create a seal around the dielectric 16; and advancing the connector 100, 200, 300, 301, 400, 500 onto an interface port 20. In many embodiments of the method, the seal member(s) 70, 270, 370, 373, 470, 570 are resilient. In other embodiments, the seal member(s) 70, 270, 370, 373, 470, 570 are substantially disposed within an annular notch 75, 275, 375, 475, 575 on the post 40, the annular notch 75, 275, 375, 475, 575 located proximate the first end 41 of the post 40. Substantially within the notch 75, 275, 375, 475, 575 may mean that the seal member(s) 70, 270, 370, 373, 470, 570 are completely within the parameters of the notch 75, 275, 375, 475, 575, or a portion of the seal member(s) 70, 270, 370, 373, 470, 570 protrude from the notch 75, 275, 375, 475, 575.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A connector comprising:

a connector body attached to a post, the post having a first end, a second end, and a flange proximate the first end, wherein the post is configured to receive a center conductor surrounded by a dielectric of a coaxial cable;

a port coupling element attached to the post; and a seal member is entirely and axially disposed within an annular notch of the post to create a seal around the dielectric to prevent entry of environmental elements, wherein the annular notch of the post is positioned along an inner surface of the post.

2. The connector of claim 1, wherein the seal member is resilient.

3. The connector of claim 1, wherein the annular notch located proximate the first end of the post.

4. The connector of claim 3, wherein a portion of the seal member protrudes from the annular notch.

5. The connector of claim 1, further including:

a fastener member radially disposed over the connector body to radially compress the coaxial cable;

a conductive seal disposed proximate the connector body, wherein the conductive seal is configured to provide a shield for preventing ingress of electromagnetic noise into the connector; and a conductive mating edge member, located proximate the first end of the post, wherein the conductive member facilitates grounding of the coaxial cable.

6. A coaxial cable connector comprising:

a connector body attached to a post, the post having a first end, a second end, and a flange proximate the first end, wherein the post is configured to receive a center conductor surrounded by a dielectric of a coaxial cable;

a port coupling element attached to the post; and a seal member integrated with the post to create a seal between the seal member and the dielectric, wherein the seal member entirely and axially integrated with the post is disposed within an annular notch along an inner surface of the post, proximate the center of the flange of the post.

7. The coaxial cable connector of claim 6, wherein the seal member is resilient.

8. The coaxial cable connector of claim 6, wherein a portion of the seal member protrudes from the notch, extending a distance from the inner surface of the post.

9. A connector comprising:

a connector body attached to a post, the post having a first end, a second end, and a flange proximate the first end, wherein the post is configured to receive a center conductor surrounded by a dielectric of a coaxial cable;

a port coupling element attached to the post; and a seal member disposed substantially within an annular notch in the flange of the post to provide a barrier around the dielectric to prevent ingress of environmental elements, wherein the seal member is flush with a mating edge of the post.

10. The connector of claim 9, wherein the seal member is resilient.

11. The connector of claim 9, wherein a portion of the seal member protrudes from the notch, extending a distance from an inner surface of the post.

12. The connector of claim 9, wherein a portion of the seal member protrudes from the notch, extending an axial distance from the mating edge of the post.

13. The connector of claim 9, wherein the seal member is a ring structure having a square or rectangular cross-section.

14. The connector of claim 9, wherein the seal member is a ring structure having a circular or curvilinear cross-section.

15. A connector comprising:

a connector body attached to a post, the post having a first end, a second end, and a flange proximate the first end, wherein the post is configured to receive a center conductor surrounded by a dielectric of a coaxial cable;

a port coupling element attached to the post;

a first seal member disposed within an annular notch in the flange of the post; and a second seal member disposed within the annular notch in the flange of the post;

wherein the first seal member and the second seal member entirely and axially is disposed within the annular notch of the post provide a barrier around the dielectric to prevent ingress of environmental elements;

wherein the annular notch is positioned along an inner surface of the post.

16. The connector of claim 15, wherein the first seal member and the second seal member are resilient.

17. The connector of claim 15, wherein the first seal member is flush with a mating edge of the post.

18. The connector of claim 15, wherein a portion of the first seal member protrudes a distance from the mating edge of the post.

19. The connector of claim 15, wherein the annular notch includes a step-configuration.

20. A connector comprising:

a connector body attached to a post, the post having a first end, a second end, and a flange proximate the first end, wherein the post is configured to receive a center conductor surrounded by a dielectric of a coaxial cable;

a port coupling element attached to the post, the port coupling element having an annular notch located along an inner surface of the port coupling element; and a seal member is entirely and axially disposed within a generally axial opening of the port coupling element to prevent ingress of environmental elements, wherein an outer edge of the seal member is disposed within the annular notch;

wherein the seal member seals directly physically against the center conductor.

21. The connector of claim 20, wherein the seal member includes an opening corresponding to the size of the center conductor, further wherein the center conductor passes axially through the opening for form part of the seal.

22. The connector of claim 20, wherein the annular notch is located between an internal lip of the port coupling element and a plurality of threads.

23. A connector comprising:

a connector body attached to a post, the post having a first end, a second end, and a flange proximate the first end, wherein the post is configured to receive a center conductor surrounded by a dielectric of a coaxial cable; and a port coupling element attached to the post;

wherein the post has an internally tapered surface at the first end, the internally tapered surface tapering radially inward toward the first end to compress the dielectric to form a seal around the dielectric.

24. A connector comprising:

a connector body attached to a post, the post having a first end, a second end, and a flange proximate the first end, wherein the post is configured to receive a center conductor surrounded by a dielectric of a coaxial cable;

a port coupling element attached to the post; and a means for providing a seal around the dielectric, wherein the means include a seal member is entirely and axially disposed proximate the dielectric and within an annular notch positioned along an inner surface of the post.

25. A method of creating a seal around a dielectric of a coaxial cable, comprising:

providing a connector including:

a connector body attached to a post, the post having a first end, a second end, and a flange proximate the first end, wherein the post is configured to receive a center conductor surrounded by a dielectric of a coaxial cable; and a port coupling element attached to the post;

disposing a seal member is entirely and axially disposed within an annular notch positioned along an inner surface of the post to create a seal around the dielectric; and advancing the connector onto an interface port.

26. The method of claim 25, wherein the seal member is resilient.

27. The method of claim 26, wherein a portion of the seal member protrudes from the notch.

28. The method of claim 25, further including:

a fastener member radially disposed over the connector body to radially compress the coaxial cable;

a conductive seal disposed proximate the connector body, wherein the conductive seal is configured to provide a shield for preventing ingress of electromagnetic noise into the connector; and a conductive mating edge member, located proximate the first end of the post, wherein the conductive member facilitates grounding of the coaxial cable.

* * * * *